US005205219A

United States Patent [19]

Groskreutz et al.

[11] Patent Number: 5,205,219

[45] Date of Patent: Apr. 27, 1993

[54] SKIER ROPE TOWING APPARATUS AND WINCH THEREFOR

[75] Inventors: Marc Groskreutz, 5121 N. Bannen, Spokane, Wash. 99216; Patrick W. Foster, Spokane, Wash.

[73] Assignee: Marc Groskreutz, Spokane, Wash.

[21] Appl. No.: 680,238

[22] Filed: Apr. 3, 1991

[51] Int. Cl.[5] ..... B61B 11/00

[52] U.S. Cl. ..... 104/173.2; 254/333; 123/400

[58] Field of Search ..... 104/173.1, 173.2, 178; 474/152, 174, 175, 189, 101, 111; 254/333, 334, 371, 380, 383, 216, 374, 402, 403; 123/400

[56] References Cited

U.S. PATENT DOCUMENTS

| | | | |
|---|---|---|---|
| Re. 30,591 | 4/1981 | Newell | 254/134.3 |
| 1,489,458 | 4/1924 | Peterson . | |
| 2,627,774 | 2/1953 | Walter | 81/84 |
| 2,646,005 | 7/1953 | Swenson | 104/173.2 |
| 2,802,636 | 8/1957 | Sandford | 254/150 |
| 2,830,478 | 4/1958 | Prince | 81/53 |
| 3,078,074 | 2/1963 | Benedict | 254/333 |
| 3,221,667 | 12/1965 | Watt | 104/173.2 |
| 3,253,850 | 5/1966 | Trusty | 294/16 |
| 3,368,498 | 2/1968 | Doveri | 104/173 |
| 3,739,728 | 6/1973 | Thompson | 104/173 |
| 3,765,614 | 10/1973 | Bartl et al. | 254/333 X |
| 3,946,969 | 4/1976 | Kaufer . | |
| 4,023,502 | 5/1977 | Elsing | 104/173 |
| 4,043,102 | 8/1977 | Uhlinger et al. | 56/17.4 |
| 4,098,196 | 7/1978 | Weihe, Jr. | 104/173.2 |
| 4,145,028 | 3/1979 | Kelley et al. . | |
| 4,256,199 | 3/1981 | Sellards | 182/11 |
| 4,294,429 | 10/1981 | Desplats | 254/333 X |
| 4,552,340 | 11/1985 | Sheppard | 254/358 |
| 4,588,167 | 5/1986 | Finzel | 254/346 |
| 4,611,542 | 9/1986 | Pivarunas | 104/173.2 |
| 4,623,036 | 11/1986 | Pondorfer | 182/142 |
| 4,681,039 | 11/1987 | Perrin | 104/193 |
| 4,681,301 | 7/1987 | Rinio | 254/333 |
| 4,920,892 | 5/1990 | Pesek | 104/173.2 |

FOREIGN PATENT DOCUMENTS

| | | | |
|---|---|---|---|
| 198409 | 10/1986 | European Pat. Off. | 104/173.2 |
| 2064455 | 6/1981 | United Kingdom | 104/173.2 |

OTHER PUBLICATIONS

Pomagalski S. A. Advertisement (POMA) "The School Skilift", pre-Apr. 1991.

Pomagalski S. A. Advertisement (POMA) "The Telekit Skilift", pre-Apr. 1991.

*Primary Examiner*—Robert J. Oberleitner
*Assistant Examiner*—Kevin D. Rutherford
*Attorney, Agent, or Firm*—Wells, St. John, Roberts, Gregory & Matkin

[57] ABSTRACT

A portable snow skier rope towing system comprises: an endless loop of flexible tow rope; a series of pulleys supporting the endless loop of tow rope for driving about an elongated enclosed path, the elongated path having opposed extreme ends, each extreme end being defined by at least one pulley; a supporting frame; a motor operably mounted relative to the supporting frame, the motor having an output drive; and a winch apparatus operably connected with the motor output drive and relative to the supporting frame, the tow rope passing through the winch at a location within the enclosed path which is displaced from each of the extreme end pulleys, the winch apparatus comprising: a drive wheel mounted for rotation and engagement with the output drive, the drive wheel having a circumference with a tapered groove formed thereabout which receives the tow rope; a rope inlet wheel mounted for rotation adjacent the drive wheel, the inlet wheel having a circumferential groove which receives the tow rope; and a rope outlet pinch wheel mounted for rotation adjacent the drive wheel, the tow rope being received about the pinch wheel, the pinch wheel being mounted for selective movement relative to the drive wheel to urge the tow rope into the tapered circumferential drive wheel groove; the drive wheel, inlet wheel, and pinch wheel being positioned relative to one another such that the tow rope is received about at least 180° and less than 360° of the drive wheel circumference.

32 Claims, 16 Drawing Sheets 10
16
18
17
12
20
24
14

Fig 12
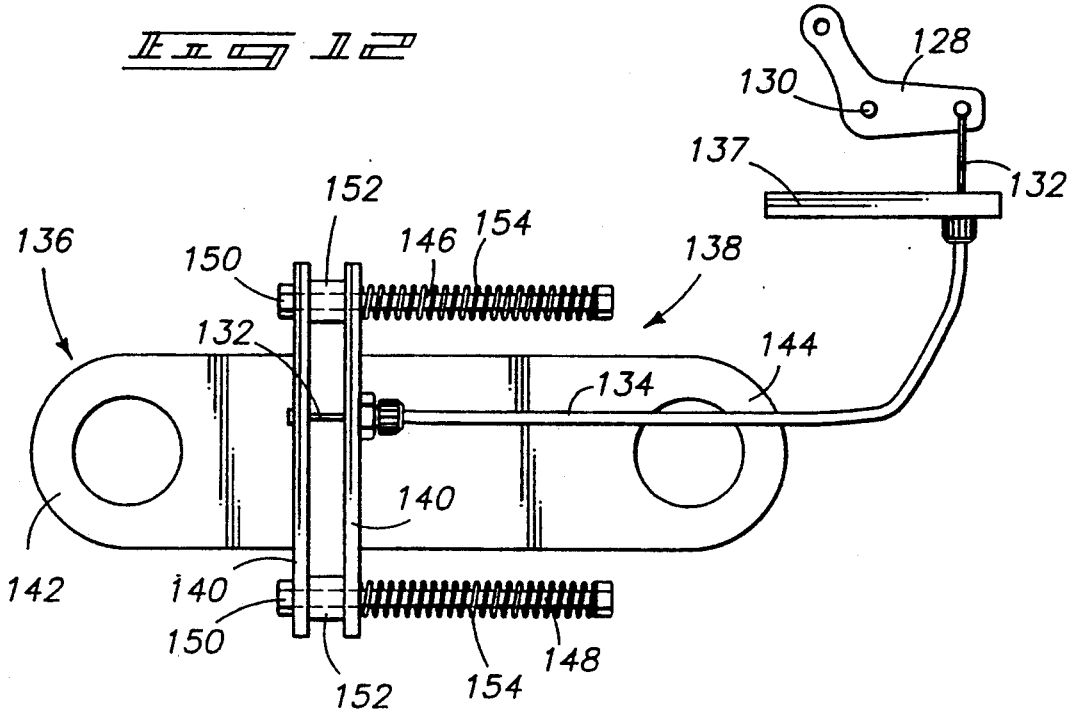
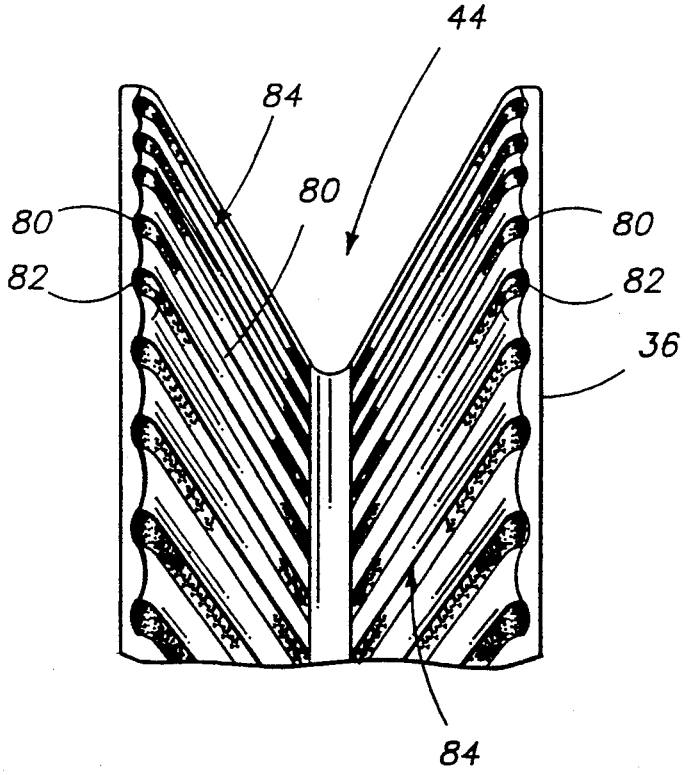
Fig 9

SKIER ROPE TOWING APPARATUS AND WINCH THEREFOR

TECHNICAL FIELD

This invention relates to portable snow skier rope tow systems.

BACKGROUND OF THE INVENTION

As the sport of skiing increases in popularity, demand on large scale existing commercial facilities in developed ski areas increases. This results in longer lift lines, and correspondingly more time spent by skiers waiting as opposed to skiing. Additionally, there are numerous areas on public and private property which would provide excellent ski slopes, but for the fact they are too remotely located or do not receive a sufficient sustained adequate snow base to justify the installation of commercial ski lifts.

Portable, small-scale lift devices have been developed to enable access to remote areas. However, such devices are typically unduly expensive, unreliable, or require an inordinate amount of time to set up and take down. Small scale lift devices are sold for example by the Dopplemayr Company of Wolfort Austria; Pomagalski S. A. of Grenoble, France and Borer Maschinenbau A. G. of Schweiz, West Germany. Such lifts most always include large circumference pulley drive wheels about which an endless loop of tow rope/cable is driven. The pulley drive wheel is positioned at one of either of the extreme ends of the enclosed loop, with an idler pulley received at the opposite loop end. The tow rope/cable is received about 180° of the circumference of the drive wheel pulley and idler pulley.

With only a 180° wrap around the drive wheel, a very large preloaded tension must be provided between the cable and wheel to assure adequate gripping force to drive the cable under load. Typically, large, heavy counterweights are employed at the idle end of the path for providing adequate tension in the cable. Other portable ski lift devices are shown, by way of example, in U.S. Pat. Nos. 3,368,498 to Doveri; 3,739,728 to Thompson; 4,023,572 to Elsing; and 4,611,542 to Pivarunas.

Various aspects of the invention disclosed herein improve upon such teachings of the prior art in producing a reliable, lower cost, portable snow skier rope towing system which is capable of being assembled and disassembled in a comparatively easy manner. Such will be apparent from the continuing discussion.

BRIEF DESCRIPTION OF THE DRAWINGS

Preferred embodiments of the invention are illustrated in the accompanying drawings, which are briefly described below.

FIG. 6 illustrates a face cover of the winch in a fully open position, as in FIG. 2. FIG. 7 illustrates a face cover of the winch at a position which is half-way between the fully open and the fully closed position. FIG. 8 illustrates the face cover in the fully closed position, as in FIG. 4;

FIG. 9 is an enlarged fragmentary end view of a rope tow winch drive wheel used in the winch apparatus of FIG. 2;

FIG. 10 is an enlarged partial overhead view of a portion of the FIG. 1 apparatus illustrating a throttle control switching means in accordance with the invention, such switching means being shown in the unloaded, idle position;

FIG. 12 is a diagrammatic view of an alternate throttle switching means in accordance with the invention;

DETAILED DESCRIPTION OF THE PREFERRED EMBODIMENTS

Figure 1:
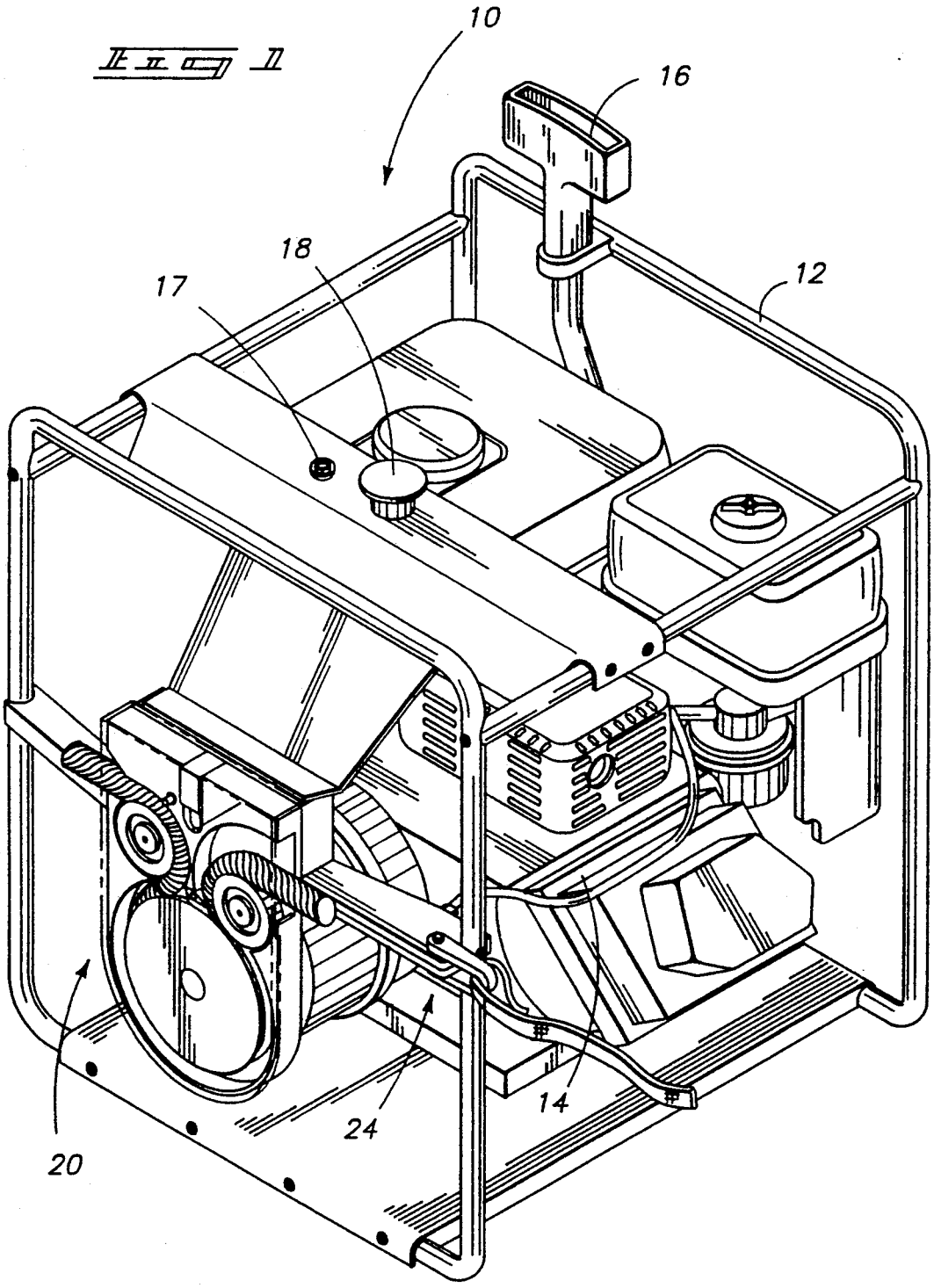
FIG. 1 is a perspective view of a portable snow skier rope towing apparatus in accordance with the invention.

This disclosure of the invention is submitted in furtherance of the constitutional purposes of the U.S. Patent Laws "to promote the progress of science and useful arts" (Article 1, Section 8).

In accordance with one aspect of the invention, a portable snow skier rope towing system comprises:

an endless loop of flexible tow rope;

a series of pulleys supporting the endless loop of tow rope for driving about an elongated enclosed path, the elongated path having opposed extreme ends, each extreme end being defined by at least one pulley;

a supporting frame;

a motor operably mounted relative to the supporting frame, the motor having an output drive; and a winch apparatus operably connected with the motor output drive and relative to the supporting frame, the tow rope passing through the winch at a location within the enclosed path which is displaced from each of the extreme end pulleys, the winch apparatus comprising:

a drive wheel (at least one) mounted for rotation and engagement with the output drive, the drive wheel having a circumference with a tapered groove formed thereabout which receives the tow rope; and a rope outlet pinch wheel mounted for rotation adjacent the drive wheel, the tow rope being received about the pinch wheel, the pinch wheel being mounted for selective movement relative to the drive wheel to urge the tow rope into the tapered circumferential drive wheel groove; the tow rope being received about at least 180° and less than 360° of the drive wheel circumference.

In accordance with another aspect of the invention, a portable snow skier rope towing system comprises:

an endless loop of flexible tow rope;

a series of pulleys supporting the endless loop of tow rope for driving about an elongated enclosed path, tension in the rope being substantially uniform throughout the path when no skier is being pulled by the tow rope, tension in the rope being nonuniform throughout the path when a skier is being pulled by the tow rope;

a drive unit comprising a motor and a drive wheel connected to the motor, the drive wheel engaging the endless loop of rope for driving the endless loop of rope about the enclosed path;

an anchor, the anchor being movable relative to the drive unit to anchor the drive unit relative to some fixed external object, the drive unit being movable relative to the ground within limits upon anchoring relative to the fixed external object;

the motor having a power actuator, the power actuator being moveable from an idle position wherein the motor idles to an increased power position wherein the power output of the motor is increased, the power actuator being moveable relative to the motor, the power actuator being biased in the direction of the idle position; and switching means mounted relative to the drive unit and connected with the actuator and anchor for imparting simultaneous movement of, a) the drive unit relative to the anchor and ground, and b) movement of the actuator between the idle and increased power positions upon a change in tension throughout the enclosed tow rope path between being substantially uniform to being nonuniform; the switching means being automatically operable to, a) move the power actuator to the increased power position upon shifting from substantially uniform tension in the tow rope path to nonuniform tension throughout the tow rope path, and b) move the power actuator to the idle position upon shifting from nonuniform tension in the tow rope path to substantially uniform tension throughout the tow rope path.

In accordance with yet another aspect of the invention, a snow skier rope tow which apparatus capable of drawing a flexible rope of selected diameter therethrough comprises:

a housing having an open face;

a drive wheel mounted to the housing for rotation relative to the housing open face, the drive wheel having a tapered circumferential groove for receiving a flexible tow rope of a selected diameter;

a rope outlet pinch wheel mounted relative to the housing open face adjacent to the drive wheel for rotation relative to the housing open face, the pinch wheel being mounted for selective movement relative to the drive wheel to urge the tow rope into the tapered circumferential drive wheel groove and thereby against the drive wheel for driving the tow rope around the drive wheel, the pinch wheel being so mounted for selective movement between a position closest to the drive wheel and a position furthest from the drive wheel; the drive wheel and pinch wheel being positioned to define a winch path for the tow rope to be received through the winch about portions of each of the drive wheel and pinch wheel in operation; the rope winch path having an inlet end and an outlet end; the rope winch path wrapping the tow rope about less than 360° of the drive wheel circumference in operation; and the drive wheel and pinch wheel being positioned relative to one another and on the housing open face to enable the selected diameter tow rope to be transversely removed from or transversely inserted into the rope winch path from the housing open face, when the pinch wheel is in the position furthest from the drive wheel, without requiring threading of the rope into the winch path from the inlet winch path end.

In accordance with still another aspect of the invention, a snow skier rope tow winch drive wheel for a portable, snow skier towing apparatus which receives a flexible tow rope therethrough comprises:

a metal body having a circular circumference, the circumference having a tapered groove (straight or curved) formed thereabout for receiving a flexible tow rope of a selected diameter, the tapered groove having projections and valleys, the valleys being filled with a ceramic material to define an exterior driving rope tow bearing surface on the body within the groove having discrete metal portions and discrete ceramic portions.

In still a further aspect of the invention, a portable, self propelled snow skier towing apparatus for use with a flexible rope for pulling a skier over snow and the apparatus along such flexible rope comprises:

a flexible tow rope securable to a stationary object for pulling the skier and apparatus relative thereto;

a supporting frame;

an internal combustion engine operably mounted relative to the supporting frame, the internal combustion engine having an output drive;

a winch operably connected with the engine output drive and relative to the supporting frame, the tow rope passing through the winch, the winch comprising:

a drive wheel mounted for rotation and engagement with the output drive, the drive wheel having a circumference with a tapered groove formed thereabout which receives the tow rope;

a rope outlet pinch wheel mounted for rotation adjacent the drive wheel, the tow rope being received about the pinch wheel, the pinch wheel being mounted for selective movement relative to the drive wheel to urge the tow rope into the tapered circumferential drive wheel groove; the pinch wheel being biased in the direction of the drive wheel; the drive wheel and pinch wheel being positioned relative to one another such that the tow rope is received about less than 360° of the drive wheel circumference;

an external inlet rope guide mounted relative to one of the frame, engine or winch which receives the tow rope by surrounding at least a substantial portion of said tow rope and guides said rope to the winch whereby operation of the internal combustion engine and pinching of the tow rope between the pinch wheel and drive wheel imparts movement of the apparatus along the tow rope in the direction of the stationary object; and means on the frame for the skier to engage relative thereto for imparting movement of a skier over snow in the direction of the stationary object upon movement of the apparatus along the tow rope.

In accordance with still a further aspect of the invention, a snow skier's rope clamping apparatus for tightly clamping onto a moving tow rope of selected diameter for pulling the skier over the snow in the direction of the moving tow rope comprises:

a pair of opposed lever arms pivotally secured relative to one another;

each lever arm having a jaw end which opposes the jaw end of the other lever arm; one of the jaw ends comprising a tapered slot sized to receive a substantial portion of the selected diameter tow rope; the other jaw end comprising a surface configured for clamping the moving tow rope into the tapered slot for selectively securing the tow rope from moving relative to the tapered slot; and a loop provided on the lever arm with the one jaw end, the loop being positioned adjacent the tapered slot for engagement with a buttocks sling.

These and other aspects of the invention will be more fully appreciated by the discussion which proceeds with reference to the accompanying drawings. Referring first to FIG. 1, a portable snow skier rope towing apparatus in accordance with an aspect of the invention is indicated generally by reference numeral 10. Apparatus 10 is comprised of a box-like rectangular and open supporting frame 12 which receives a motor 14. Motor 14 can be a conventional internal combustion engine having a hand-start pull cord 16. For pulling one skier at a time with 1200 feet of endless tow rope, up a 10° to 20° slope at a rate of 600 feet per minute at 6000 feet elevation, 3.5 to 5 horsepower has been determined to be adequate. Five horsepower should be sufficient for pulling one skier with 2400 feet of endless rope up a 30° to 45° slope at 600 feet per minute at 6000 feet elevation.

An emergency stop switch 18 is provided for stopping the engine. Additionally, a jack 17 is provided which interconnects with the stop circuit of the motor. Jack 17 could be used with another external safety stop, such as a swing gate. Alternately, a timer mechanism might be employed which shuts the unit off after some preset time period.

Motor 14 has an output drive shaft (not shown in FIG. 1) which drives a winch apparatus 20 mounted relative to the frame and motor. Winch apparatus 20 and motor 14 in combination comprise a drive unit which operably mounts relative to supporting frame 12. Winch apparatus 20 drives an endless loop of flexible tow rope 22, as will be more fully described below. An anchoring mechanism 24 is movably connected relative to the drive unit for anchoring the drive unit to some fixed external object. More specifically, anchoring mechanism 24 is movably connected to frame 12 to anchor frame 12 to some fixed external object, and accordingly the drive unit mounted thereto to some fixed external object. Frame 12 is moveable relative to the ground surface upon which it rests within limits upon anchoring of frame 12, as also will be more fully described below.

Reference is now made to FIGS. 2-9 for a more detailed description of winch apparatus 20. Winch apparatus 20 is capable of drawing a flexible tow rope 22 of selected diameter therethrough. It comprises a body or housing 26 having a generally open face 28 which is mounted to face outwardly relative to motor 14 and frame 12. (FIG. 1) Face 28 includes recessed areas 30, 32, 34 which receive a drive wheel 36, rope inlet wheel 38 and rope outlet pinch wheel 40, respectively. Drive wheel 36 is centrally mounted relative to the drive shaft of the motor for rotation relative to open face 28. The motor drive shaft is designated with numeral 42. Drive wheel 40 includes a tapered circumferential groove 44 which receives tow rope 22. Groove 44 is illustrated as having straight side walls, but could be configured with curved sidewalls.

Figure 2:
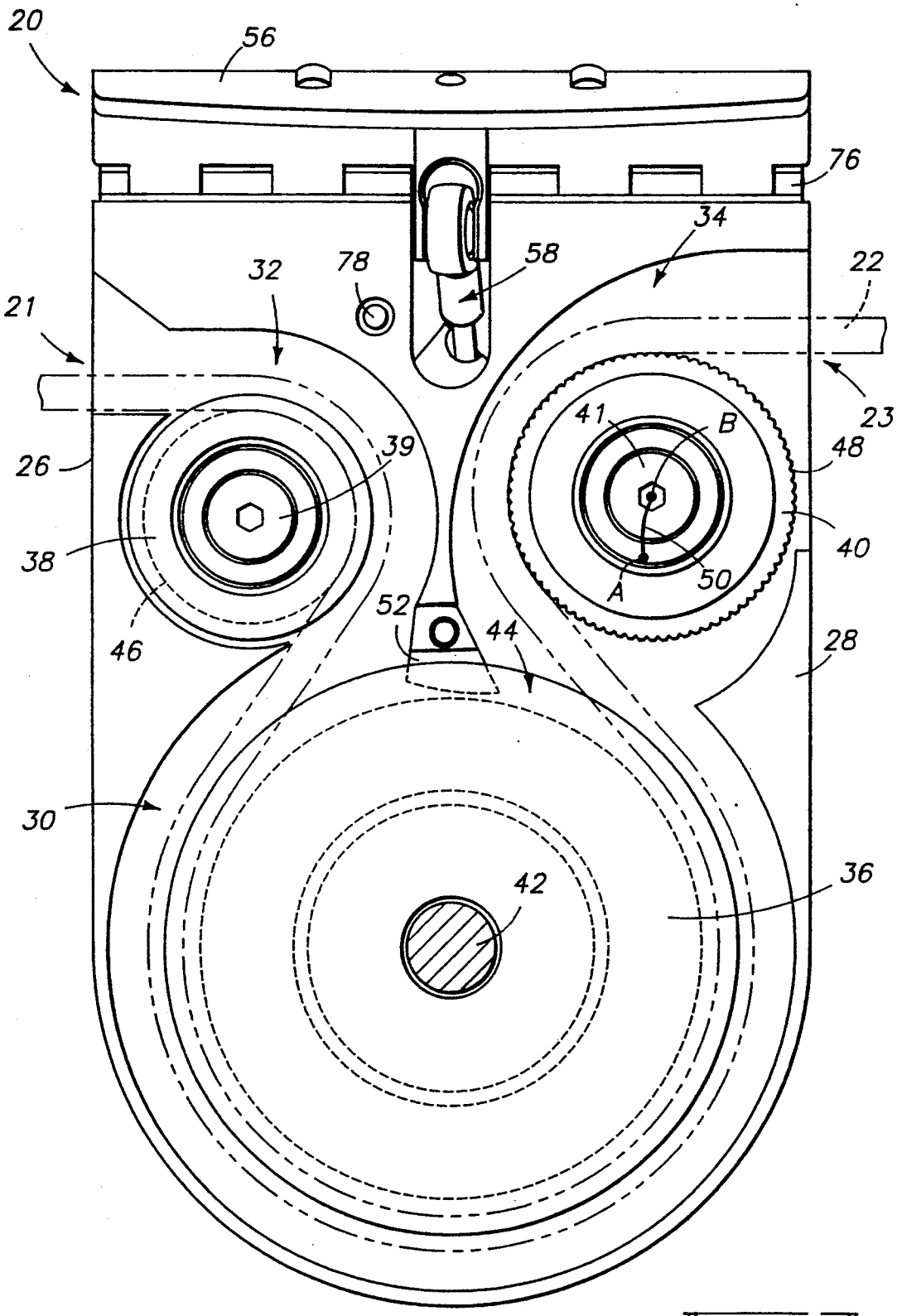
FIG. 2 is an enlarged front elevational view of a snow skier rope tow winch apparatus employed in the apparatus of FIG. 1, shown in a condition for loading or unloading a flexible tow rope thereto.
Figure 3:
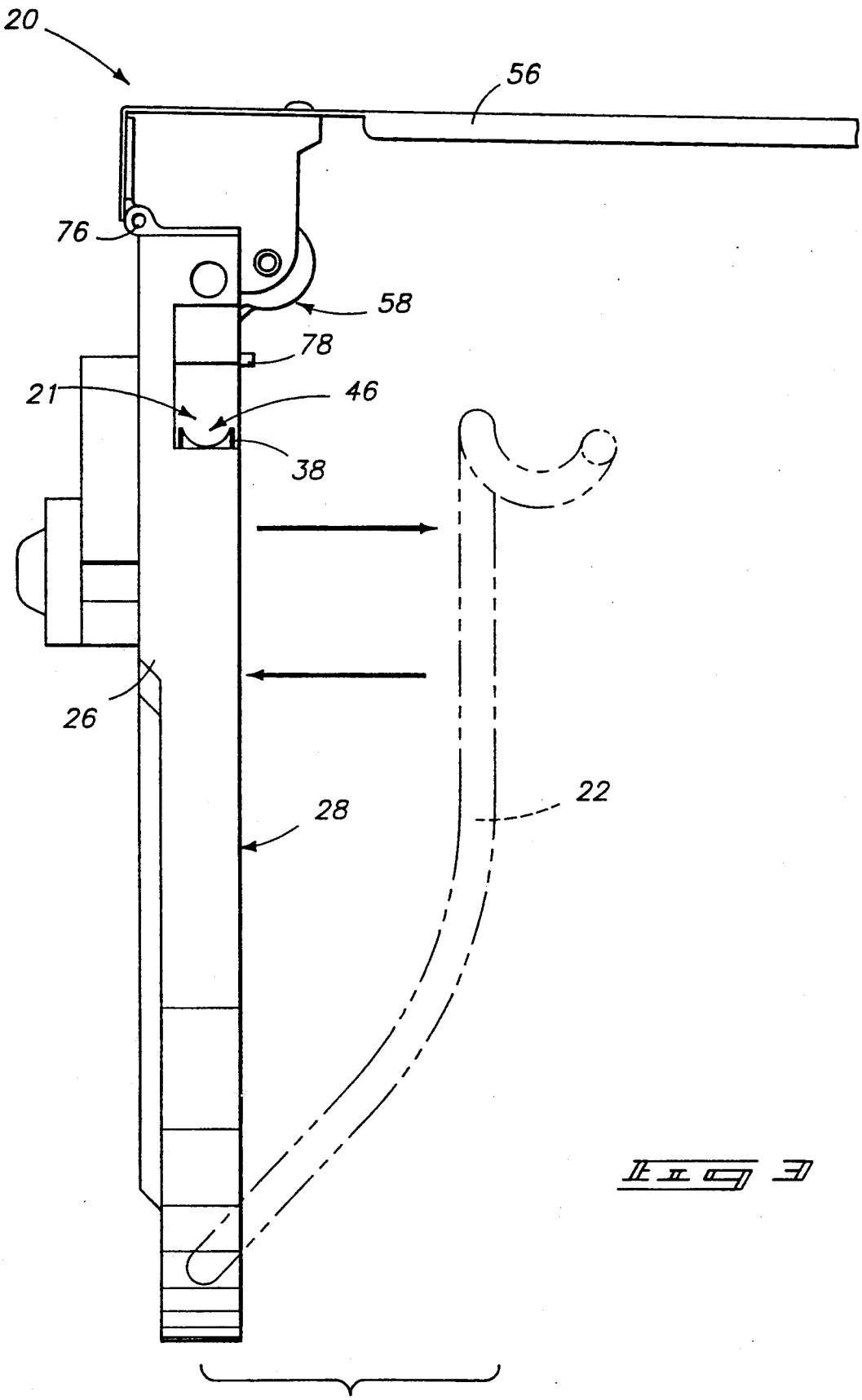
FIG. 3 is a side elevational view of the apparatus of FIG. 2.
Figure 4:
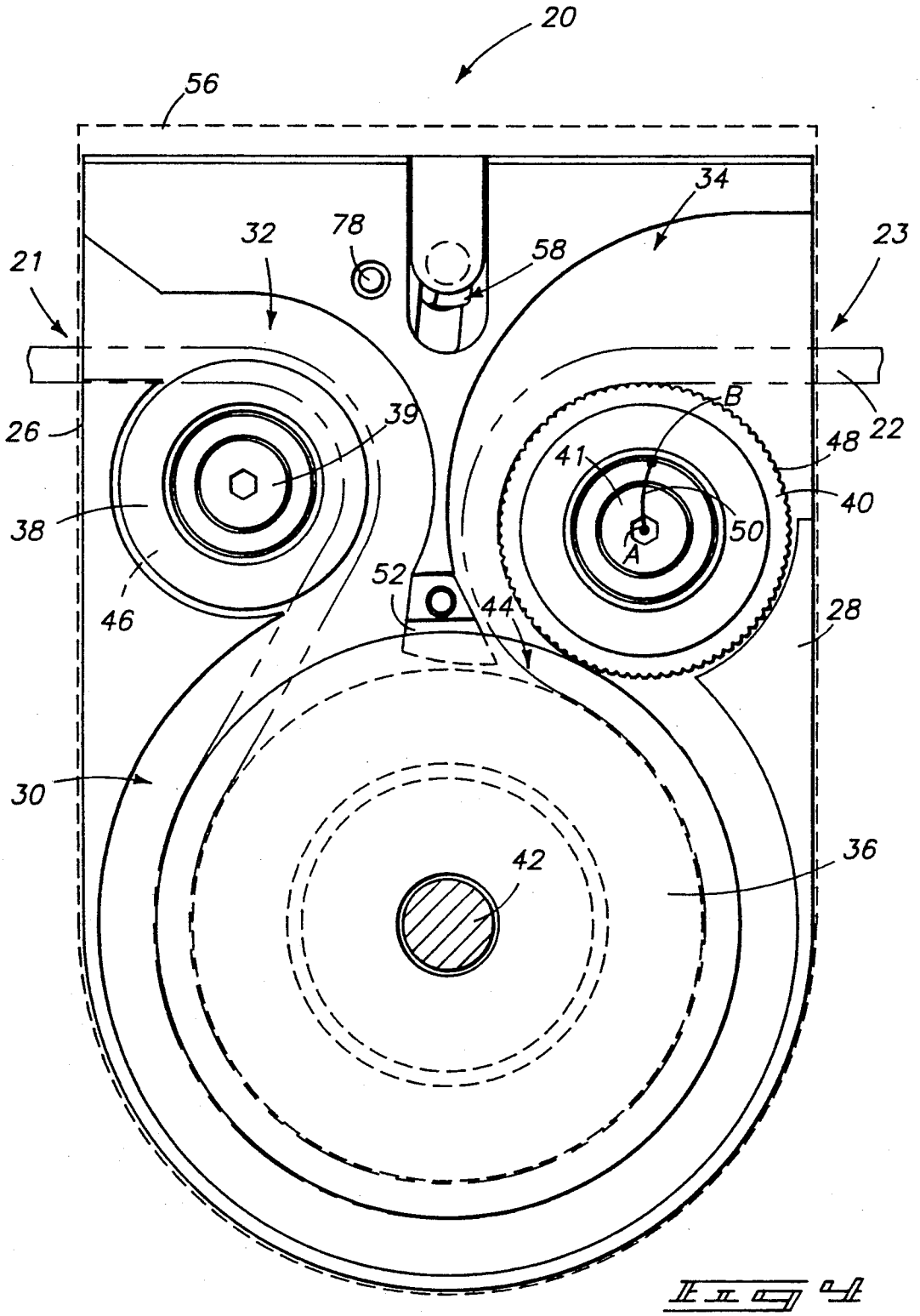
FIG. 4 is a side elevational view of the winch apparatus of FIG. 2 shown in a loaded and ready condition, with a pivoting face cover on such winch being shown in phantom.

Rope inlet wheel 38 is mounted as shown relative to housing open face 28 for rotation adjacent drive wheel 36. Inlet wheel 38 is provided with a circumferential groove 46 which receives tow rope 22. Rope outlet pinch wheel 40 is mounted relative to housing open face 28 oppositely adjacent drive wheel 36 for rotation relative thereto as shown. Outlet pinch wheel 40 includes a roughened outer surface 48 which includes a series of axial grooves. Tow rope 22 is received about surface 48. Pinch wheel 40 is mounted for selective movement between extreme central positions A, B about an arc 50. In this manner, wheel 40 is moveable toward and away from drive wheel 36 to urge tow rope 22 tightly into tapered circumferential drive wheel groove 44, and thereby against drive wheel 36 for driving tow rope 22 therearound. Pinch wheel central position A positions pinch wheel 40 closest to drive wheel for operation (FIG. 4), while position B is furthest from drive wheel 36 for insertion or removal of rope 22 relative to winch 20 (FIG. 2).

Each of rope wheels 38 and 40 is rotationally supported about a shouldered bolt or shaft 39, 41 respectively. Drive wheel 36 is supported by a drive shaft 42 extending from motor 14.

Drive wheel 36, rope inlet wheel 38, and rope outlet pinch wheel 40 are positioned relative to one another to define a serpentine winch path about which tow rope 22 is received through the winch in operation. As shown, rope 22 is received about portions of each of drive wheel 36, rope inlet wheel 38 and pinch outlet wheel 40. The winch path includes an inlet end 21 and an outlet end 23 relative to winch body 26. A divider 52 extends into drive wheel groove 44 to assure separation of rope 22 from the drive wheel to avoid any tendency of the rope wrapping completely around drive wheel 36 in operation. The winch path wraps tow rope 22 about at least 180° and less than 360° of the drive wheel circumference. Preferably, tow rope 22 is received about more than 180°, as shown.

Drive wheel 36, rope inlet wheel 38, and rope pinch outlet wheel 40 are positioned relative to one another and within recesses 30, 32, 34 respectively, on housing open face 28 to enable easy removal and insertion of rope 22 relative to winch 20. Specifically, such wheels are positioned to enable the selected diameter tow rope 22 to be transversely removed from or transversely inserted into the rope winch path from housing open face 28 when pinch wheel 40 is in position B furthest from drive wheel 36. This is accommodated by the positioning and size of the wheels relative to the recesses within open face 28. With pinch wheel 40 in the B position (FIGS. 2 and 3), space is provided within the recesses at the exterior of the circumference of each of the wheels which exceeds the diameter of rope 22. This enables rope 22 to be loosened and removed transversely out or inserted into winch 20 relative to open face 28 (see specifically FIG. 3). This eliminates any requirement of threading of the rope into the winch path from the inlet winch path end 21.

Winch apparatus 20 includes an open face cover 56 which is movably mounted relative to housing 26 for movement between an open position (FIGS. 2, 3, and 6) which exposes open face 28, and a covering position (FIGS. 4, 5 and 8) which covers open face 28 during operation. More specifically, door 56 is mounted relative to the top of hosing 26 by means of a hinge 76 for swinging pivotal movement between open and closed positions. Interconnecting linkage 58 connects face cover 56 with pinch roller 40 to impart movement of pinch roller 40 to central position A closest to drive wheel 36 upon movement of face cover 56 to the covering position. Interconnecting linkage 58 as well imparts movement of pinch roller 40 to position B furthest from drive wheel 36 upon movement of face cover 56 to the open position. Such is readily perceived by viewing FIGS. 5–8.

Figure 5:
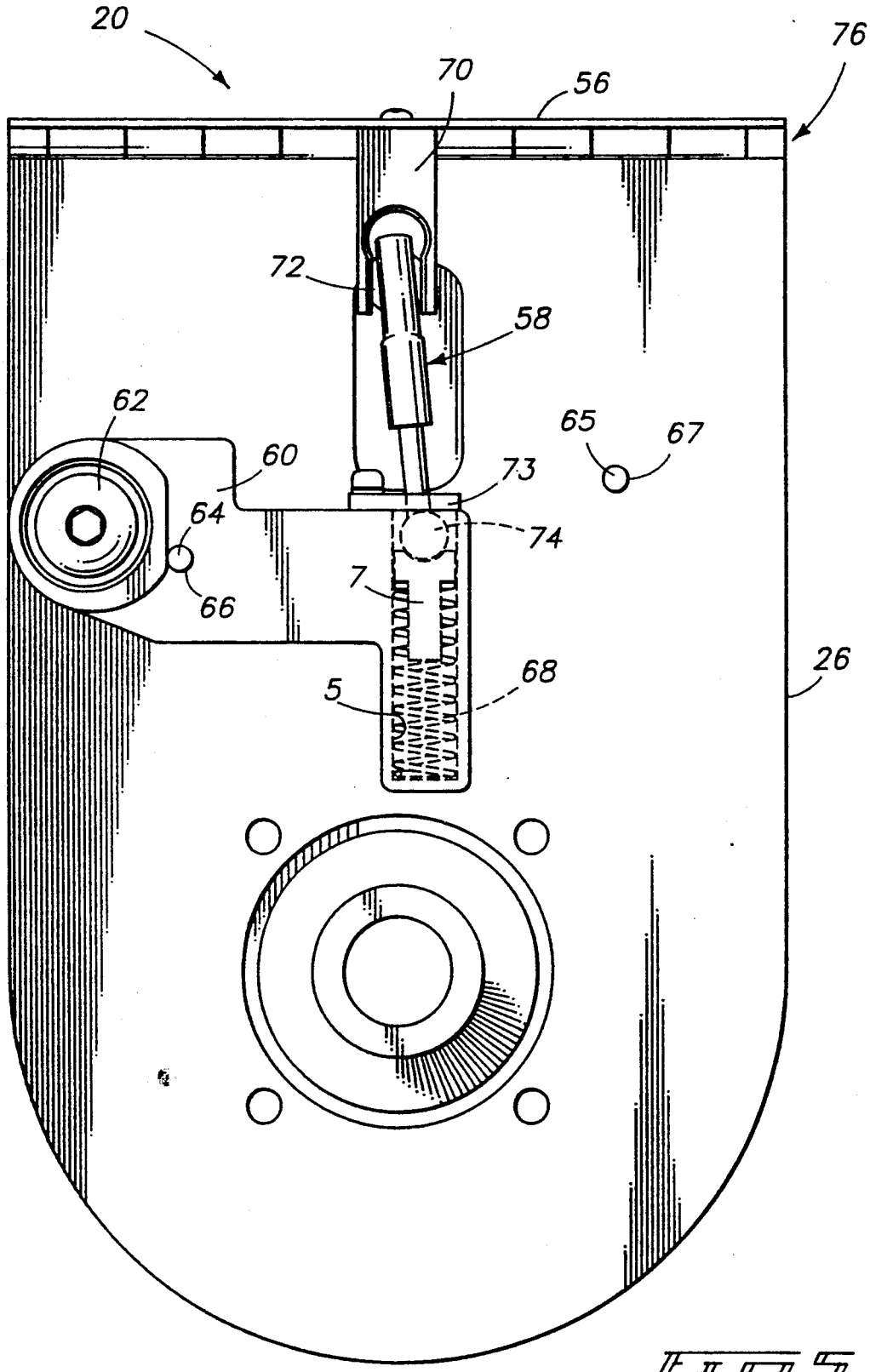
FIG. 5 is a rear elevational view of the rope tow winch apparatus of FIG. 2.

Specifically, outlet pinch roller 40 is pivotally supported for movement between its extreme central positions A, B by means of a lever 60. Lever 60 is pivotally mounted at one of its ends by a pivot rod and bearing assembly 62. The rear portion of shouldered bolt 41 which supports wheel 40 for rotation has a threaded stud 64 which threads into an opening 66 formed in lever 60. (As well, the rear portion of shouldered bolt 39 which supports wheel 38 for rotation narrows to a threaded stud 65 which threads into an opening 67 formed in housing 26.) The end of lever 60 opposite the end which receives rod and bearing assembly 62 includes an elongated internal cavity 5 which receives a spring 68 (FIG. 5). An elongated ball seat 7, preferably made of a plastic material such as urethane, extends into the top of spring 68 and bears against linkage 58. Spring 68 functions to bias lever arm 60 in a clockwise direction as shown in FIG. 5, and correspondingly bias pinch wheel 40 in the direction of central location A.

Interconnecting linkage 58 comprises a ball and socket linkage, one end of which engages which cover 56, the other end of which engages with lever 60. Specifically, cover 56 includes a forked clevis 70 which receives a ball joint 72 of linkage 58. The opposite end of linkage 58 includes a ball 74 which is operably received within the lever cavity housing 5, within a recess of ball seat 7, and correspondingly against spring 68. Ball 74 is retained within cavity 5 by means of a hook clamp 73. Spring 68 biases against ball 74 to bias lever arm 60 downward (clockwise from the rear) as shown, and correspondingly wheel 40 in the direction of the driving wheel 36. Such biasing force and limited movement of wheel 40 will accommodate splices in the endless rope and enable the winch to accommodate ropes of slightly different sizes, such as by way of example only 5/16 inch and ⅜ inch diameter ropes for a given construction.

Figure 6:
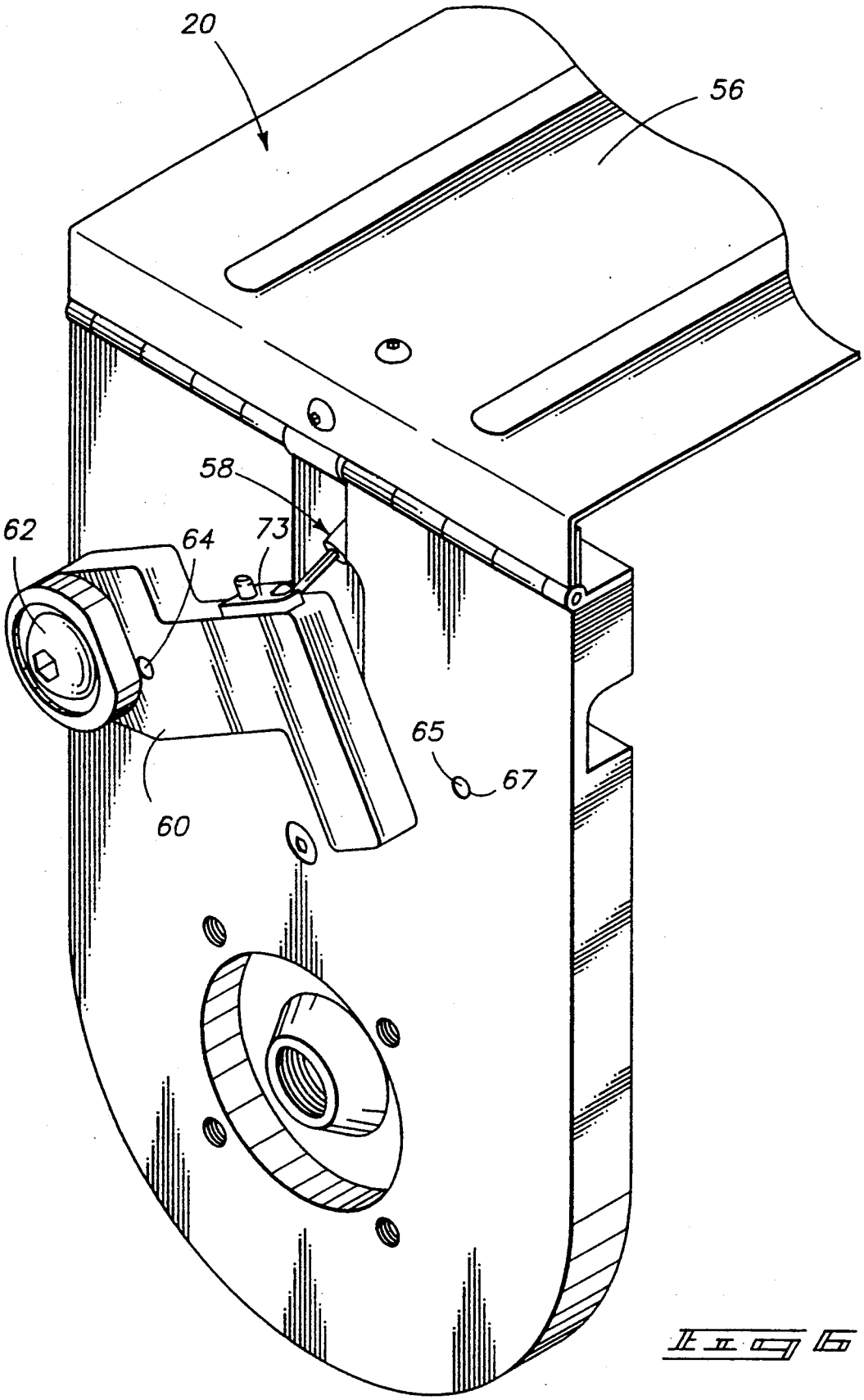
FIGS. 6, 7 and 8 are side rear perspective views of the rope tow winch apparatus of FIG. 2.
Figure 7:
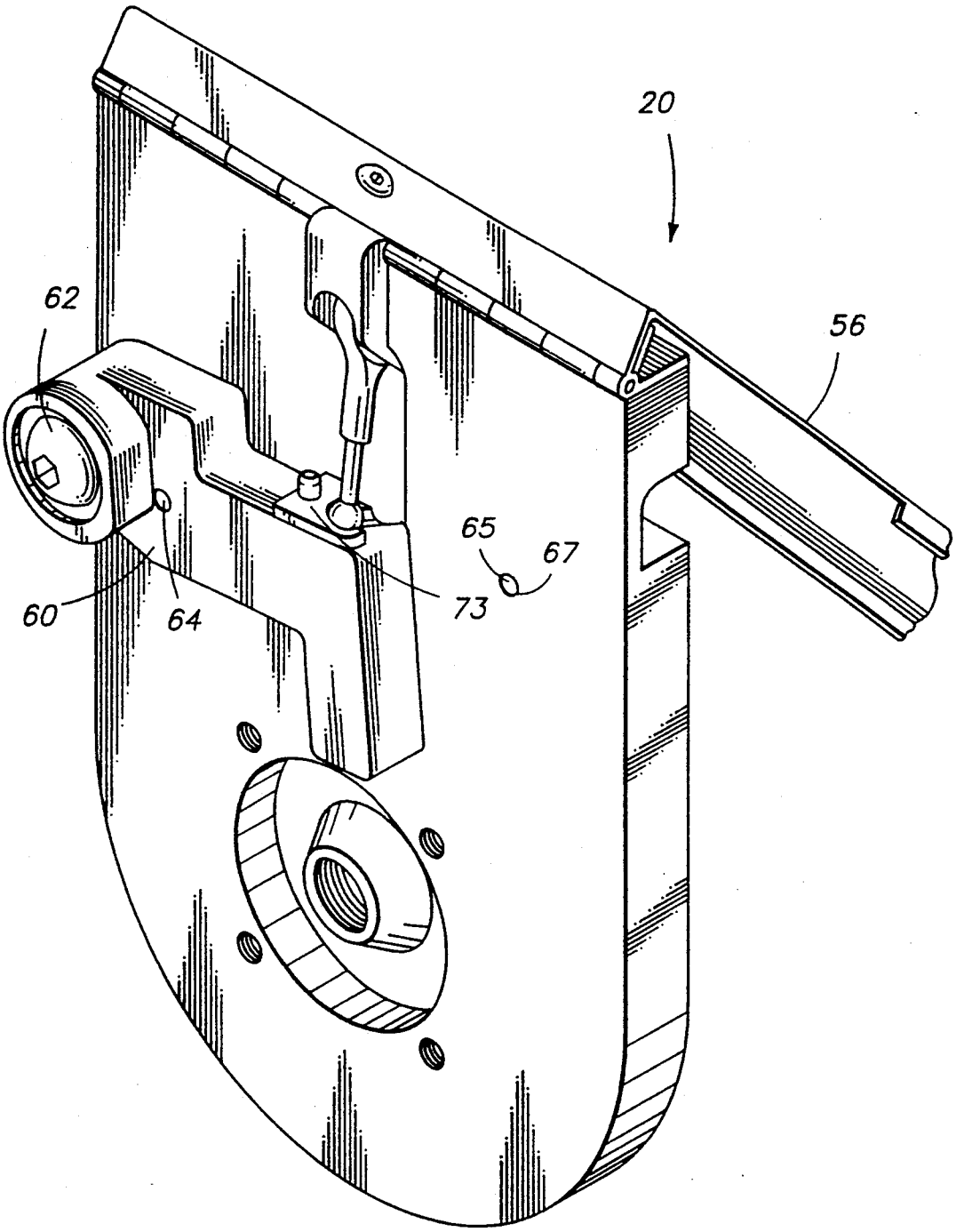
Figure 8:
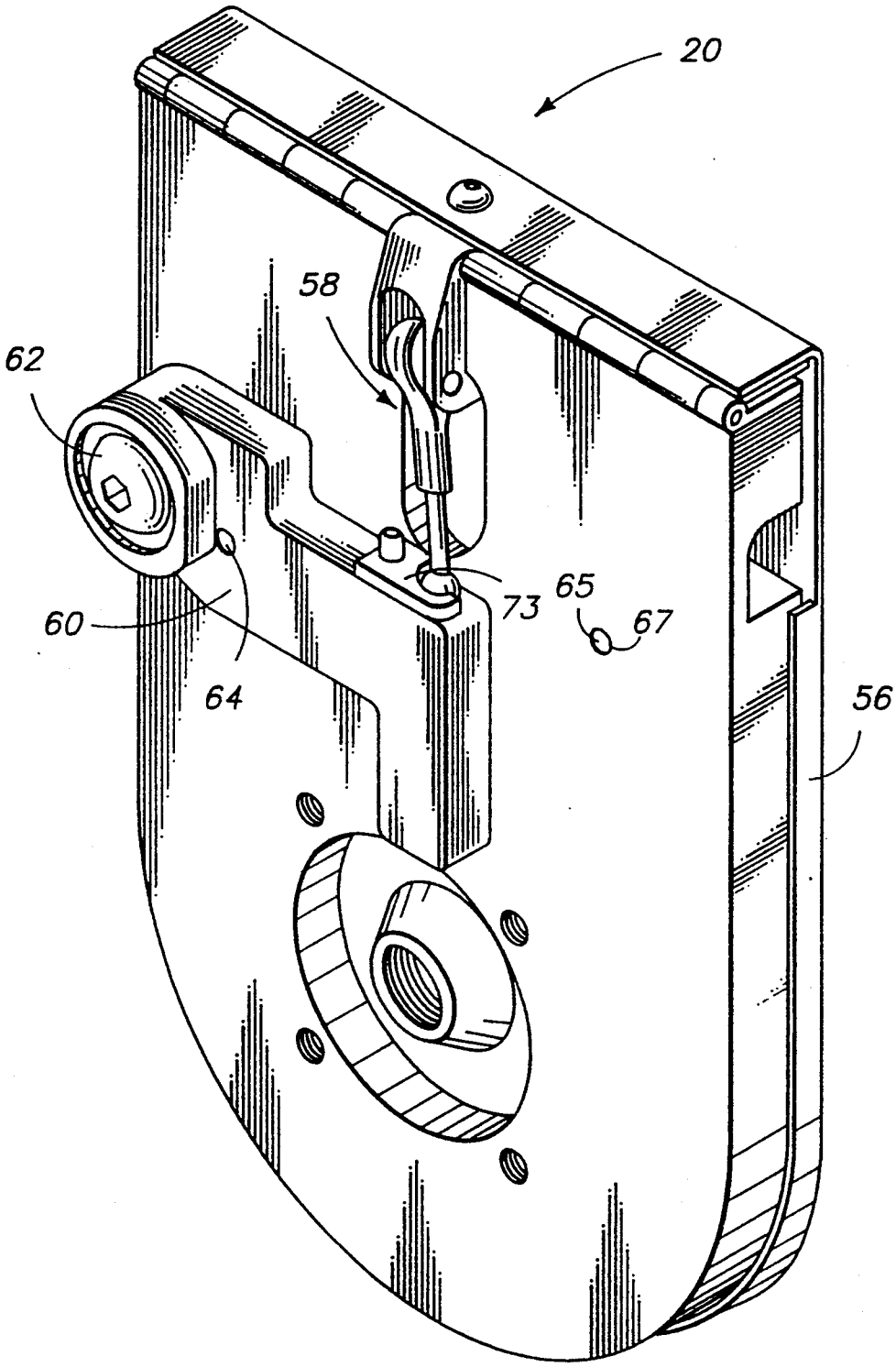

FIG. 6 illustrates cover 56 in its full open position, and correspondingly lever 60 pivoted to its full upward position. This places the central portion of wheel 40 at location B (FIG. 2) furthest from drive wheel 40. As cover 56 begins to be closed (FIG. 7), linkage 58 pushes against or relative to lever 60 and correspondingly moves wheel 40 in the direction of drive wheel 36, until the point of being completely closed (FIG. 8). Ball joint 72 in cooperation with cover clevis 70 is pushed to an over-center, secure position to maintain wheel 40 in a fixed position relative to drive wheel 36 in normal operation.

Apparatus 10 further is provided with a secondary automatic safety kill switch 78 on face 28 of housing 26. Kill switch 78 is in the form of an outwardly biased button switch which projects laterally (FIG. 3) from face 28. Cover 56 in operation normally covers the rotating wheels for safety purposes. When cover 56 is closed, button switch 78 is fully inwardly depressed. When cover 56 is opened, even partially, button 78 pops out. Switch 78 operably connects with motor 14 for disabling the motor when face cover 56 is in any position other than the completely covering position. Such a switch will require that the face be closed for the engine to be started. Further, were a knot in the rope or some other object entered into the winch sufficiently to pop open the cover 56, the motor would be stopped enabling the situation to be remedied before damaging the equipment.

Housing 26, and wheels 36, 38 and 40 are preferably principally comprised of metal, such as aluminum. Referring to FIG. 9, tapered groove 44 of drive wheel 40 is preferably provided with walls angled at 60°, and will typically be driven by an internal combustion engine at up to 800 rpm. During manufacture, groove 44 is most preferably provided with secondary radial grooves formed thereabout which define projections 82 and valleys (grooves) 80. The preferred grooves 80 in the wheel are 1/16 inch wide and 0.030 inches deep. Valleys or grooves 80 are filled with a ceramic material to define an exterior, generally flat driving rope tow bearing surface 84 within groove 44 having discrete metal portions and discrete ceramic portions. Such a combination ceramic/aluminum wheel has been determined to provide a good balance between wheel life and providing a suitable friction surface to frictionally engage the tow rope, which may at times have snow or ice thereon. An example ceramic composition for filling grooves 80 is an 87% alumina, 13% titanium composition, having a finished hardness of 65. The filling of grooves 80 with such material would typically be conducted by plasma spraying, as would be known by people of skill in the plasma spraying art. The coated and filled grooves 80 can be smoothed by sanding with aluminum oxide paper, as desired.

Figure 9A:
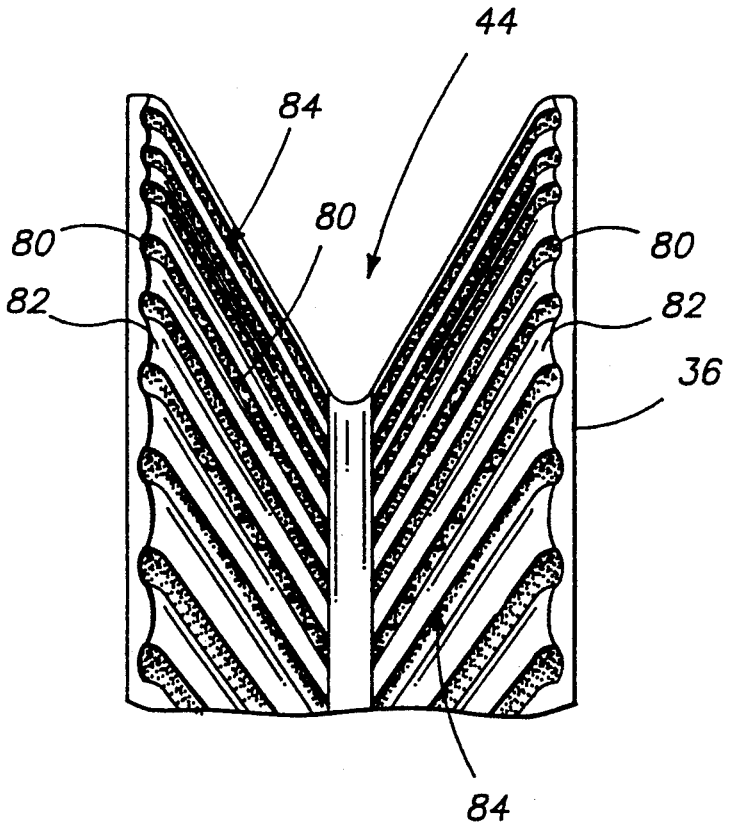
FIG. 9*a* is an enlarged fragmentary end view of an alternative rope tow winch drive wheel used in the winch apparatus of FIG. 2.

Alternately, but less preferred, grooves or valleys 80 could merely be roughened or otherwise knurled for improved traction without applying ceramic material thereto. (FIG. 9*a*).

The above-described winch apparatus enables the rope to be connected therewith at any point along the rope without having to thread an end of the rope into the drive unit. Further, the spring loaded pinch roller provides constant equal pressure on the rope passing through the winch in operation. Load applied on the rope pulls the rope into the drive groove providing adequate traction to drive the rope without requiring tension on the rope where it exits the winch.

Figure 11B:
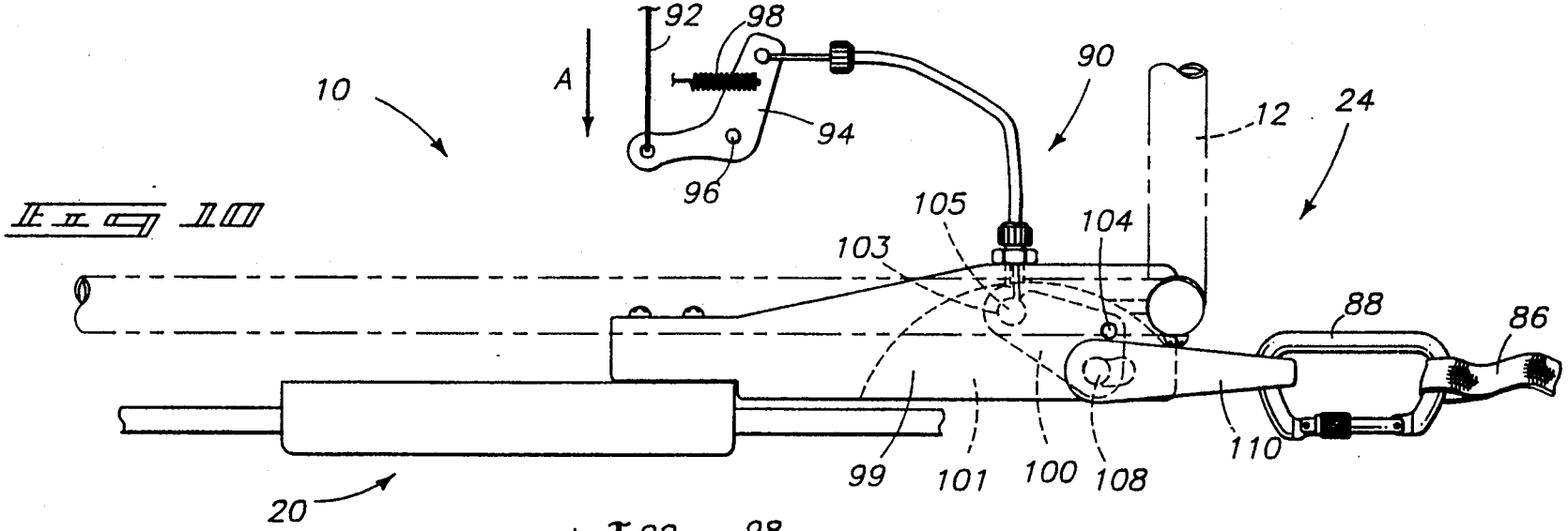
FIG. 11 is an enlarged partial overhead view of a portion of the FIG. 1 apparatus illustrating a throttle control switching means in accordance with the invention, such switching means being shown in the loaded, full throttle position.
Figure 11A:
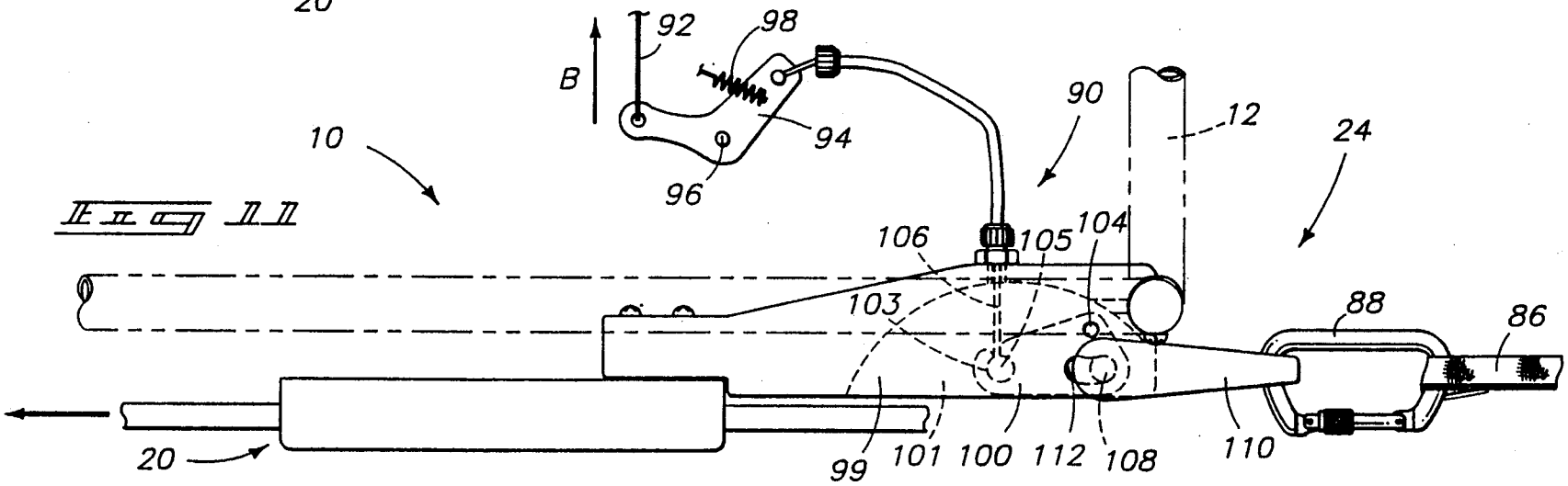

Referring to FIGS. 1, 10 and 11, anchoring mechanism 24 is generally comprised of a flexible strap or rope 86 which could be secured to a suitable external object, such as a stake, rock, or tree. Strap 86 engages with frame 12 by means of a clip 88. Clip 88 engages with switching means, designated generally by numeral 90, which functions to apply full throttle to motor 14 when a skier grasps rope 22, and yet return motor 14 to a lower power, idle condition when the skier releases from rope 22. Specifically, clip 88 engages with a clevis 110 which is moveable relative to frame 12 and engages with switching means 90.

Switching means 90 incorporates the power actuator of the motor, which in the case of an internal combustion engine is typically a throttle lever. Specifically, the motor power actuator in FIGS. 10 and 11 is diagrammatically illustrated by a bar or cable 92, which is pivotally supported at the end of a lever 94. Cable 92 would connect with the motor throttle. Lever 94 is pivotally supported at its center about a pivot rod 96, which would typically mount relative to motor 14 (not shown). Lever 94 and bar 92 are moveable between an idle position (FIG. 10) wherein the motor idles, to a full and increased power position (FIG. 11) wherein the power output of the motor is increased. Lever 94 and correspondingly bar 92 are biased in the direction of the idle position by an appropriately anchored spring 98 to assist in maintaining the motor in an idle position when minimal load is place on the system.

A switching body 99 having a cavity 101 is mounted relative to frame 12 as shown. A lever 100 is pivotally mounted relative to supporting frame 12 and switching body 99 within cavity 101. One end of lever 100 mounts relative to anchor clamp 88, while the other end of lever 100 is connected relative to biased throttle lever 94. More particularly, lever 100 is pivotally supported for pivoting about a fixed pivot pin 104. A cable 106 extends between one end of lever 94 and one end of lever 100. Cable 106 extends through an appropriate protecting housing 108. The one end of lever 100 includes a round slotted opening 103 which receives a disc 105 connected at the end of cable 106. Accordingly, pivoting movement of lever 100 about pivot pin 104 will pivot throttle lever 94 about its pivot pin 96 and correspondingly throttle the motor.

The opposite end of lever 100 includes a hole 108 which receives a pin of clevis assembly 110. Switching body 99 includes a slot 112 extending vertically therethrough. This enables clevis assembly 110 to move relative to body 102, and correspondingly relative to supporting frame 12 through a distance defined by the length of slot 112. The opposite end of clevis 110 engages with clip 88.

Accordingly, pulling movement of clip 88 towards the right (alternately the entire apparatus 10 to the left) as shown in FIG. 11 pivots lever 100 about pin 104 in the counterclockwise direction and pulls against cable 106. This correspondingly increases the throttle of the motor through bar or cable 92 being moved by pivot action of lever 94 about pivot 96. Such a switching mechanism is automatically operable to move the throttle to the increased power position upon a single skier grasping and thereby tensioning the rope. As well, the mechanism will move the power actuator to the idle position upon release of the rope by the single skier, as will be more fully described below.

The described portable snow skier rope towing system can be set up in a number of configurations, in large part due to the above-described winching mechanism which does not require a high-tension rope system. One example setup and system is illustrated diagrammatically in FIG. 13. The system includes a series of pulleys 114, 116, 118, 120 and 122 which support the endless loop of tow rope 22 for driving about the illustrated elongated enclosed path. Each of such pulleys would be secured or anchored by means of individual anchoring lines 124. Such pulleys would be anchored typically relative to trees or other objects above the snow surface. The elongated enclosed path will typically have extreme ends, which in the depicted embodiment are defined at one end by the relative positions of pulleys 114 and 116, and at the opposite end by pulleys 118 and 122.

Pulley 118 is anchored and tensioned by means of a spring reel tensioner 126. This will take up slack in the rope behind the drive when load is applied by a skier grasping the rope. Such slack stems in part from stretch that occurs in the rope upon application of a load. For example, a 5/16 inch polypropylene rope 2400 feet in length will stretch 10 feet under a load of 20 pounds; 20 feet under a load of 50 pounds; 25 feet under a load of 100 pounds; and 30 feet under a load of 150 pounds. Such slack will manifest within the enclosed loop between the load (the moving skier) and the outlet side of winch apparatus 20. Tensioner 126 will take up such slack and as well provide some minimum tension throughout the rope at idle under no load. A tensioner providing 20 pounds of force on the rope path is preferred.

Figure 13:
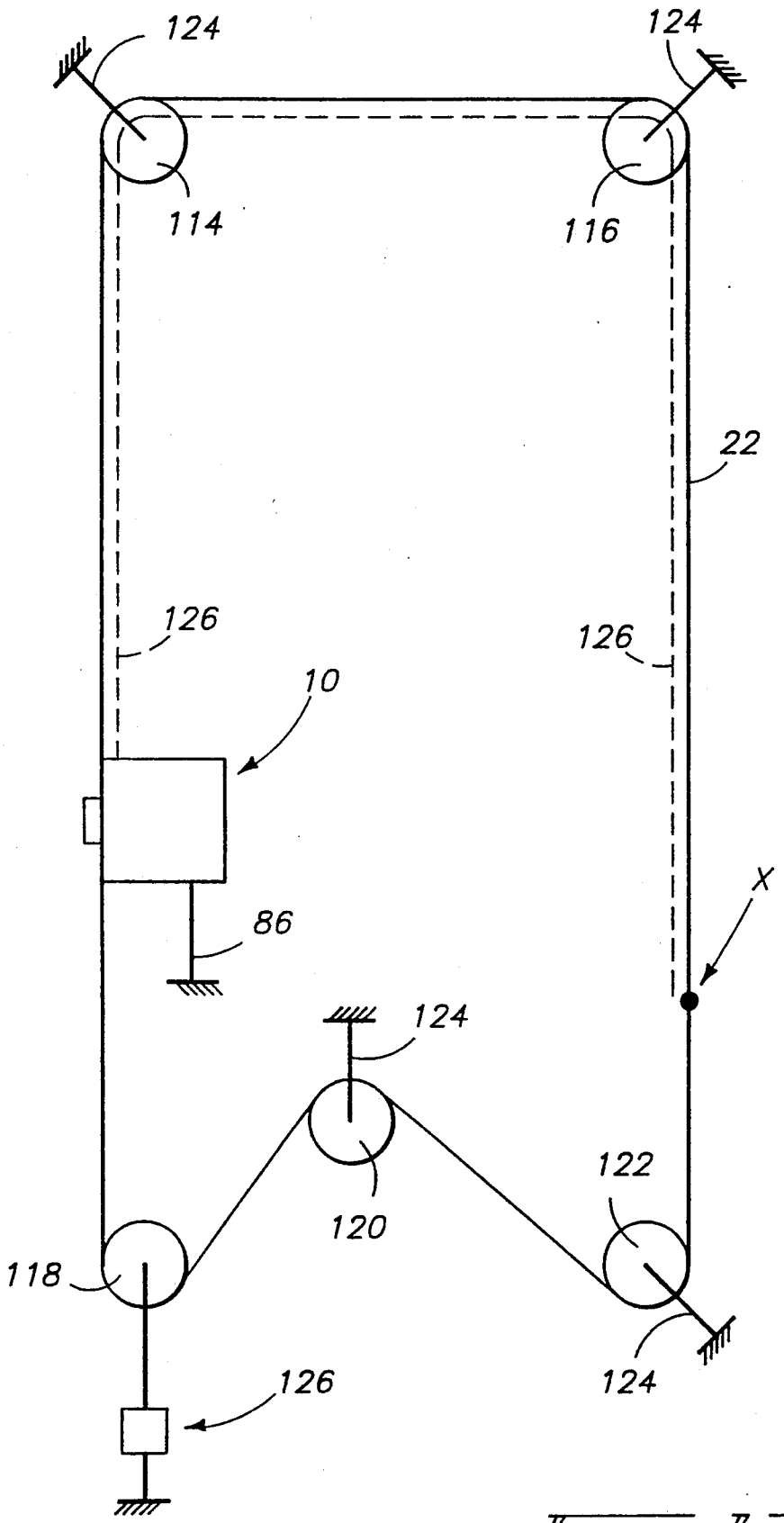
FIG. 13 is a diagrammatic plan view of portable snow skier rope towing system in accordance with the invention, with an appropriate drive motor being positioned towards the bottom of a ski slope.

The preferred embodiment for a system setup is illustrated by FIG. 13 wherein the winch and drive apparatus 10 is configured towards the bottom of the slope and on the downhill, return side of the loop. When no skier is being pulled by the rope, the tension in the rope will be substantially uniform throughout, with the rope being drivable by a comparatively small force of, for example, only two pounds. The above-described system with a 3.5 to 5 horsepower motor, 1200 feet of rope, 20° slope, and 6000 feet elevation can be driven at an idle setting of the motor and still propel the rope around the loop when not pulling a load.

In the depicted system, tension in the rope throughout the path will not be uniform when a skier is being pulled by the rope. For example, imagine a skier engaging the rope at location "X" at some point in time. At the point of grasping the rope and being pulled therealong, tension in the rope increases within the path between the skier and where the rope enters the winch for pulling. Additionally, the rope stretches, as indicated above. The high tension portion is indicated by dashed line 126 in FIG. 13. As the distance between location X and the drive unit 10 is substantially constant, the 20 feet or more of rope stretch results is a corresponding amount of slack between location X and the outlet portion of drive unit 10. Section 126 would be under tension ahead of the skier as the skier is being pulled up the hill. Average full tension of the high tension section of the rope under load of pulling an average skier would be approximately 150 pounds at 30° to 40° slope at 600 feet per minute.

It is to be noted that the rope behind the skier between the skier and outlet end of drive apparatus 10 will be under no tension, except for the 20 pound tension provided by spring tensioner 126. As also will be appreciated, as the skier is pulled along the rope, the amount of the path which is under tension decreases while the amount of rope under minimal tension increases.

Note however with the above-described position that drive unit 10 could be positioned upon essentially any of the segments between any two pulleys shown about the loop. This is illustrated by way of example in FIG. 14.

Here, drive unit 10 is positioned closer to the top portion of the slope and on the up-hill pulling side of the loop. Here, the tension portion 126 of the rope between the drive unit 10 and skier at the same location X covers a shorter portion of the rope loop path than in the FIG. 13 embodiment.

Figure 14:
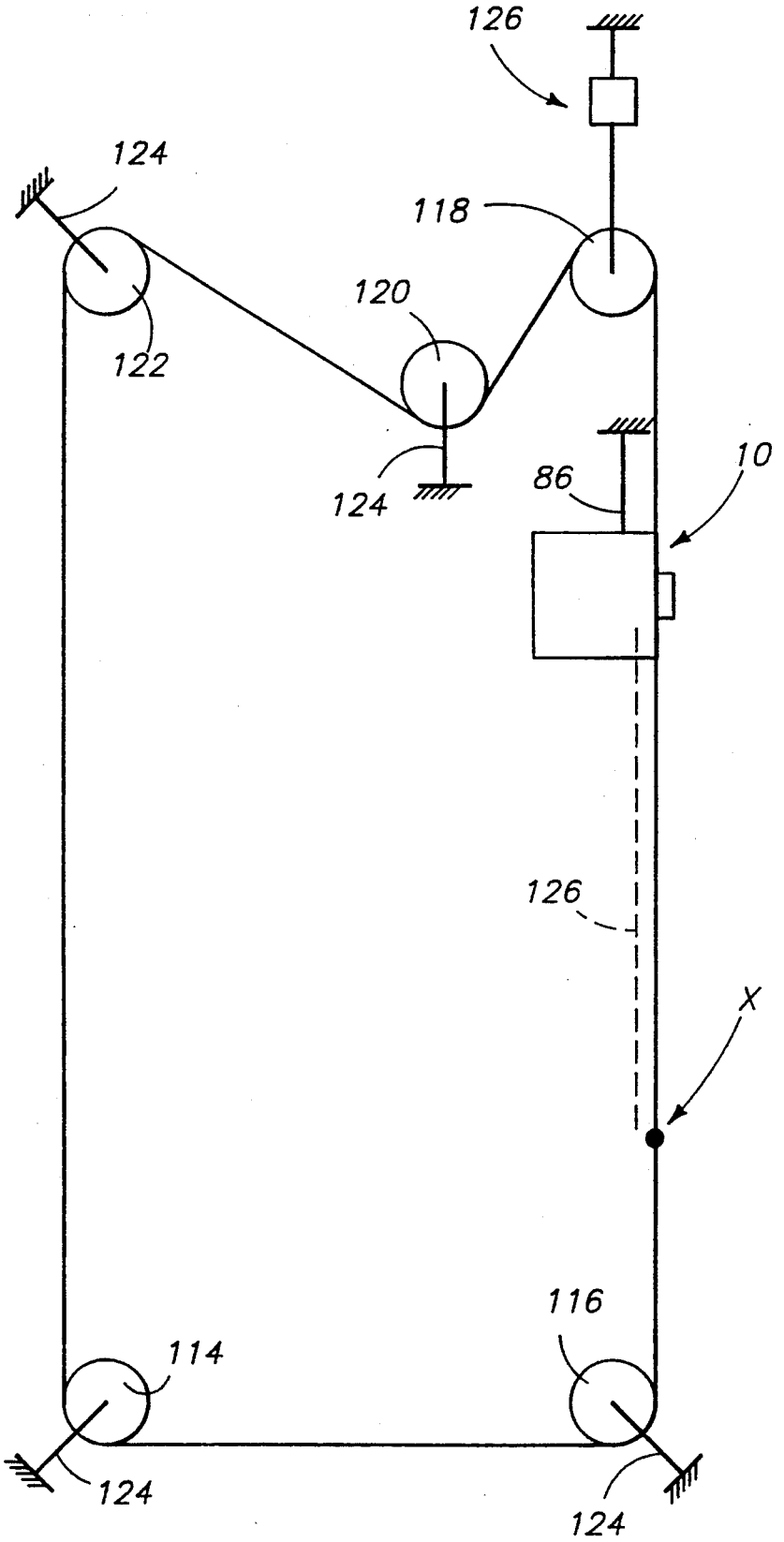
FIG. 14 is a diagrammatic plan view of portable snow skier rope towing system in accordance with the invention, with an appropriate drive motor being positioned towards the top of a ski slope.

In both of the FIGS. 13 and 14 embodiments, drive apparatus 10 is positioned such that rope 22 passes through the winch at a location which is positionally between the extreme path ends defined by pulleys 114, 116 and opposite end pulleys 118, 122. In any event, it is expected that tow rope 22 will pass through the drive apparatus 10 at some location within the rope enclosed path which is displaced from any of extreme end pulleys 114, 116, 118, and 122, unlike the prior art.

Operation of the above-described switching means will now be more readily understood with reference to FIGS. 10, 11, 13 and 14. Assume a setup as shown in FIGS. 13 or 14 wherein no skier has engaged the rope for pulling up the slope. Further under such condition, presume the motor is running at idle condition with the switch setup such as is shown in FIG. 10. In other words, the throttle is in the idle position, with the frame and clevis unit 110 being positioned as shown with flex being exhibited within rope or strap 86. Under such conditions, tension is substantially uniform throughout the rope path.

Upon grasping of the rope by a skier at location X, the rope stretches and tension becomes nonuniform throughout the path whereby higher tension is experienced along the path section between the inlet portion of the winch and skier (portion 126). Such higher tension in this area of the rope causes driving apparatus 10 to be pulled towards the skier in the opposite direction in which the rope is being driven. Such causes the frame of drive unit 10 to be pulled relative to anchor strap 86 such that the strap becomes rigid. Accordingly, the entire frame 12 of drive unit 10 is displaced slightly relative to the anchoring point. Such is depicted in FIGS. 10 and 11, whereby positionally frame 12 has been pulled towards the left through a distance equal to the length of slot 112 in FIG. 11 relative to that position of frame 12 in FIG. 10.

Such pulling force in effect opens the throttle of the motor to the full high speed position by means of the above-described switching mechanism 90. The pulling force causes lever 100 to be displaced relative to the frame as indicated in FIG. 11, and correspondingly cable 92 moved to the full throttle position by engagement through cable assembly 106.

Upon release of the rope by the skier, rope tension is released. This causes the rope to rebound and in combination with the spring of throttle lever 98 causes apparatus 10 to move back against the anchor, such as to the right as illustrated in FIG. 10. This thereby returns the motor to the idle position upon release of the tension and reestablishment of uniform tension throughout the rope path. Accordingly in this manner, the switching means imparts simultaneous movement of the supporting frame relative to the anchor and ground, and movement of the actuator between the idle and increased power positions upon a change in tension throughout the rope tow path between being substantially uniform to being nonuniform.

Accordingly, the above-described switching means provides full throttle under load, and idle power upon release of load. Light spring pressure (example five pounds) reduces the throttle to idle. Additionally, such a system provides a smooth-start for the skier when the system is used by a one skier at a time. Alternate switching means constructions could of course be employed without departing from the principles and scope of this aspect of the invention. By way of example only, the motor could be slidably mounted relative the frame with the frame being solidly anchored relative to the ground, and the switching means engaging relative to the frame and movable motor. In this manner, the frame would be considered as part of the anchor which is movably connected relative thereto to enable limited movement of the drive unit relative to the anchor point.

The above-described system is anticipated to be usable principally when pulling only one skier at a time up the rope, although the above-described switching means and components could be configured for pulling multiple skiers up the rope. However, such would typically require a higher powered motor and a higher tension rope for accommodating the corresponding increase in load.

One example of yet another alternate switching means is diagrammatically illustrated in FIG. 12. A throttle or other power actuator of a motor is indicated by numeral 128, and is pivotally mounted about a pivot point 130. A cable 132 secures to an end of the lever arm and extends through a cable housing 134 and engages relative to a pair of opposed members 136, 138. One end of cable housing 134 would be fixedly secured relative to some fixed mount 137, such as to the motor itself or to the frame which supports the motor. The opposite end of cable housing 134 is secured relative to member 138. Cable 132 extends and connects with member 136.

Opposed members 136 and 138 are mounted for movement toward and away from one another. Specifically, each comprises a plate portion 140 having a respective projection 142, 144 extending therefrom. One of projections 142 or 144 would be secured relative to a fixed external object, while the other would be secured relative to the motor frame to which the motor is mounted. Cable 132 extends through an opening in plate 140 of member 138 and engages with the opposed plate 140 of member 136. A pair of bolts 146, 148 extends through plates 140 of each member 136 and 138. Bolts 146, 148 are rigidly secured relative to plate 140 of member 136 by means of nuts and spacers 150, 152, respectively. Member 138 is slidable along bolts 146, 148 and biased in the direction of the other opposing member by means of springs 154.

As will be apparent from the above discussion, as soon as tension is applied to the rope loop the tendency is for the drive unit to be pulled in the direction of the skier. With one of members 136 and 138 being secured relative to an external anchor point, such engagement of the tow rope will cause members 138 and 136 to be pulled away from one another. The effect will be to pull the cable relative to the fixed mount 137 and correspondingly throttle lever 128 in the clockwise direction as shown. Note that in this described alternate embodiment, springs 154 function as the biasing means to bias throttle level 128 in the idle condition of no load (the counter clockwise direction).

Figure 18:
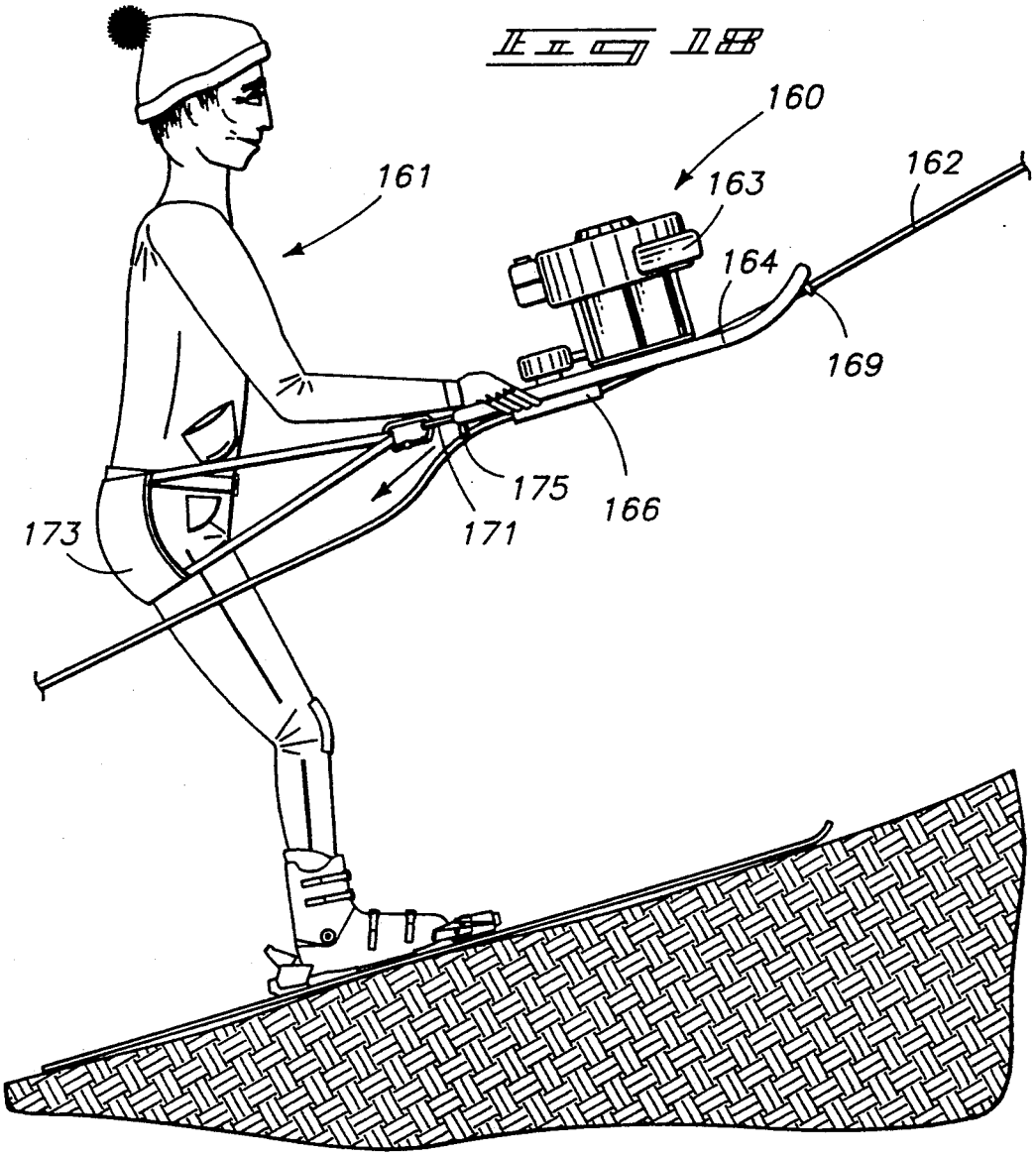
FIG. 18 is a perspective view of an alternate embodiment portable self propelled snow skier towing apparatus shown pulling a skier along a rope.
Figure 19:
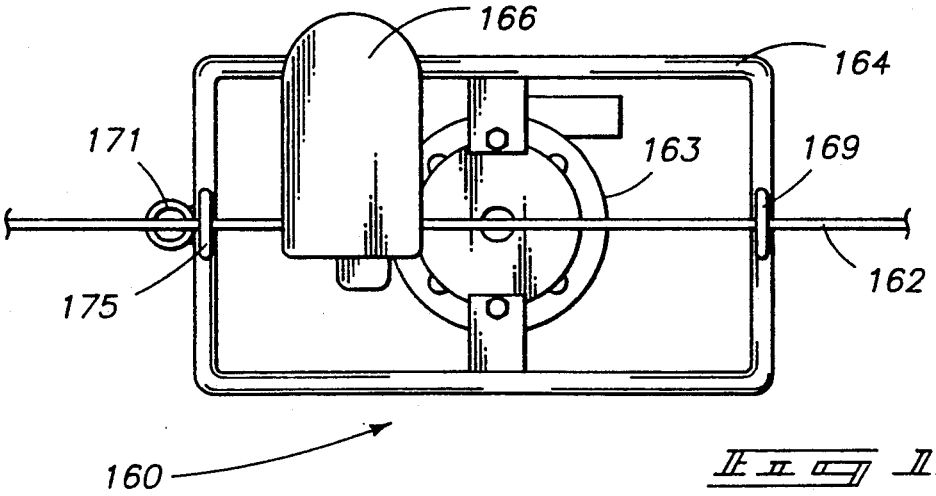
FIG. 19 is an enlarged bottom view of the FIG. 18 apparatus.

Aspects of the above-described components can be incorporated in a portable, self propelled snow skier towing apparatus for use with a flexible rope for pulling a skier over snow and the apparatus along the flexible rope. Such as system is illustrated in FIGS. 18 and 19 and indicated generally by reference numeral 160. Such a system will incorporate a flexible tow rope 162 which would be secured relative to some external stationary object (not shown), such as a rock, tree or stake, for pulling the apparatus 160 and skier 161 relative to and along the rope.

Apparatus 160 includes a supporting frame 164 which supports a suitable internal combustion engine 163. A winch apparatus 166, such as described above, would operably connect with the engine output drive and relative to supporting frame 164, with tow rope 162 passing therethrough. An external inlet rope guide 169 is mounted relative to frame 164 which receives tow rope 162. Inlet rope guide 169 could as well be mounted to some other stationary object such as the winch frame or motor frame. Rope guide 169 is in the form of a hook or complete loop which surroundings substantially the entire tow rope for guiding the tow rope to the inlet of the winch. Thereby, operation of the internal combustion engine and pinching of the tow rope between the pinch wheel and drive wheel of the winch imparts movement of the apparatus along the tow rope in the direction of the stationary object to which it is secured. A rope outlet guide 175 could as well be provided.

Some means are provided on the frame for the skier to engage relative thereto for imparting movement of the skier over the snow in the direction of the stationary object upon movement of the apparatus along the rope. Such means could be simply provided in the form of a handle area on the frame for the skier to grasp onto as the unit moves. Alternately and more preferably, a hook or loop 171 could be provided which would receive a diaper-like sling 173 which hooks thereto as shown in FIG. 18.

It is anticipated that the drive unit of apparatus 10 would typically directly drive the associated drive pulley 136 of the winch apparatus 20. It would be preferred however to provide some sort of clutching mechanism, such as a centrifugal clutch, with respect to the embodiment of apparatus 160 which is expected to move along a rope and pull a skier relative thereto. With such an embodiment, it is anticipated that a skier would ski down the hill to the end of a rope with the drive unit retained by the skier, such as in a backpack. Upon reaching the bottom, the unit would be removed and installed relative to the rope. Then, the unit would be started. From an idle condition, the throttle would be increased which would engage a centrifugal clutch and cause movement of the skier and apparatus up along the rope.

Such an assembly could be built into a sled and drive itself up or down a rope on a ground surface with or without an operator or skier. Provision could be provided for shutting off the engine once it reaches the bottom or top of a slope.

Figure 15:
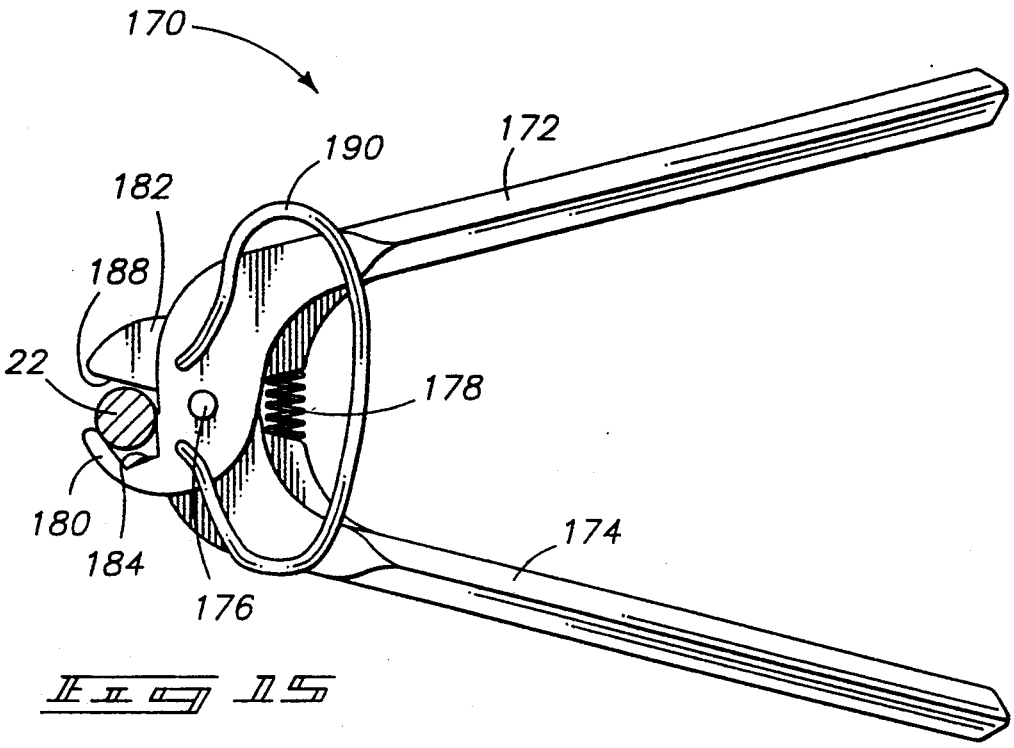
FIG. 15 is a side elevational view of a snow skier's rope clamping apparatus for tightly clamping onto a moving tow rope of selected diameter, in accordance with the invention.
Figure 16:
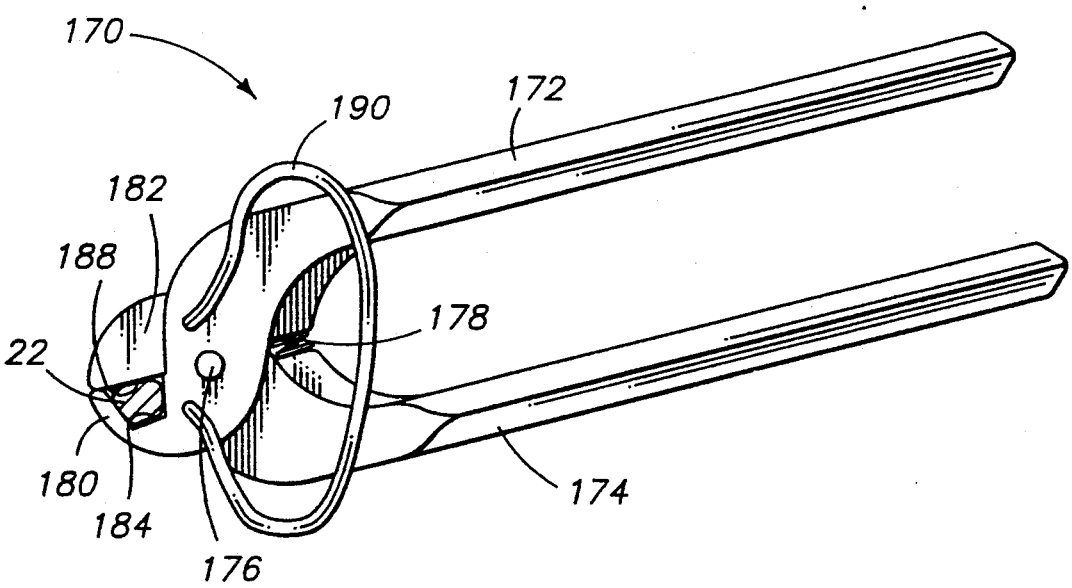
FIG. 16 is a side elevational view of the clamping apparatus of FIG. 15 shown in a clamping position.
Figure 17:
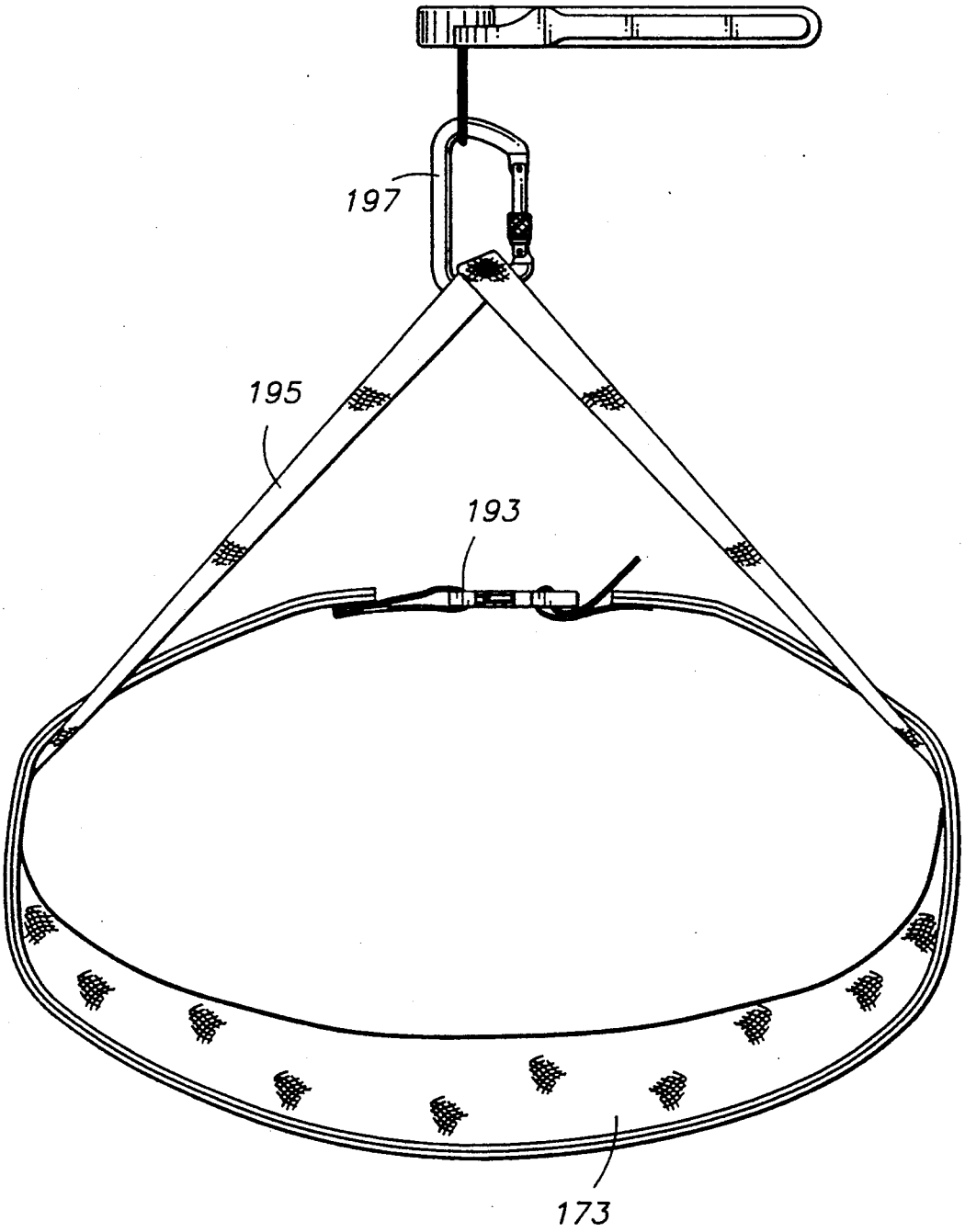
FIG. 17 is a overhead plan view illustrating use of the FIG. 15 clamp with a harness/sling for pulling a skier along a tow rope.

It is anticipated that the above-described apparatus will be utilized principally with non-wire ropes of approximately 5/16 inch to ¾ inch thickness or less. Such small diameter ropes would be expected to be difficult to grasp by a skier without causing rope burn or excessive wear of ski gloves and mittens. Accordingly, a preferred clamping apparatus and sling for engaging between the skier and rope is illustrated in FIGS. 15–17. Referring first to FIGS. 15 and 16, a snow skier's rope clamping apparatus for tightly clamping onto a moving tow rope of selected diameter for pulling the skier over the snow in the direction of the moving tow rope is indicated generally with reference numeral 170. Clamp 170 is comprised of a pair of opposed lever arms 172, 174. Each is secured pivotally relative to one another about a pivot 176. Arms 172 and 174 are biased outwardly from one another by a coil spring 178 connected therebetween.

Lever arms 172, 174 have jaw ends 180, 182 respectively, which oppose the jaw end of the other lever arm. Jaw end 180 is comprised of a single tapered slot 184 which is sized to receive a substantial portion of a selected diameter tow rope 22. Jaw end 182 of arm 174 comprise a flat surface 188 which is configured for clamping or depressing moving tow rope 22 tightly into tapered slot 184 for selectively securing tow rope 22 from moving relative to tapered slot 184 and correspondingly the entire apparatus (FIG. 16).

A sling loop 190, in the form of a wire cable, is provided on lever arm 172 having the slotting jaw end. Loop 90 could as well be in the form of a rigid ring, hook, clasp, etc. Loop 190 is positioned adjacent tapered slot 184 for engagement with a buttocks sling 173 (FIG. 17). The preferred mounting is to place sling loop 190 on the slotted jaw 172 for receiving a substantial force of the tow rope, with the remaining clamp lever being able to be utilized solely for forcing and clamping tow rope 162 within slot 184.

Buttocks sling 173 comprises a flexible woven fabric having a clasp 193 for securing about a skier. A strap loop 195 extends from sling 173 and hooks with loop 190 through an intermediate clip 197.

With such a clamp construction, the pivot point is never under strain (i.e. it holds no load). Such a construction provides a sufficient grip on the rope under maximum load, although it requires minimum hand pressure. The rope releases from the clamp completely under the no-load condition when the clamp is released by the skier.

In compliance with the statute, the invention has been described in language more or less specific as to structural and methodical features. It is to be understood, however, that the invention is not limited to the specific features shown and described, since the means and construction herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A portable snow skier rope towing system comprising:

an endless loop of flexible tow rope;

a series of pulleys supporting the endless loop of tow rope for driving about an elongated enclosed path, the elongated path having opposed extreme ends, each extreme end being defined by at least one end pulley;

a supporting frame separate from said series of pulleys and separate from said end pulleys;

a motor operably mounted relative to the supporting frame, the motor having an output drive; and a winch apparatus operably connected with the motor output drive and relative to the supporting frame, the tow rope passing through the winch at a location within the enclosed path which is displaced from each of the extreme end pulleys, the winch apparatus comprising:

a drive wheel mounted for rotation and engagement with the output drive, the drive wheel having a circumference with a tapered groove formed thereabout which receives the tow rope; and a rope outlet pinch wheel mounted for rotation adjacent the drive wheel, the tow rope being received about the pinch wheel, the pinch wheel being mounted for selective movement relative to the drive wheel to urge the tow rope into the tapered circumferential drive wheel groove; the tow rope being received about at least 180° and less than 360° of the drive wheel circumference.

2. The portable snow skier rope towing system of claim 1 wherein the location within the enclosed path where the tow rope passes through the winch apparatus is positionally between the extreme path ends.

3. The portable snow skier rope towing system of claim 1 wherein the winch apparatus comprises:

a housing having an open face; the drive wheel and pinch wheel being rotationally mounted relative to the open face;

means for movably mounting the pinch wheel for selective movement between a position closest to the drive wheel and a position furthest from the drive wheel;

the drive wheel and pinch wheel being positioned to define a winch path for the tow rope to be received through the winch about portions of each of the drive wheel and pinch wheel in operation; the rope winch path having an inlet end and an outlet end; and the drive wheel and pinch wheel being positioned relative to one another and on the housing open face to enable the selected diameter tow rope to be transversely removed from or transversely inserted into the rope winch path from the housing open face, when the pinch wheel is in the position furthest from the drive wheel, without requiring threading of the rope into the winch path from the inlet winch path end.

4. The portable snow skier rope towing system of claim 3 further comprising an open face cover movably mounted relative to the housing for movement between an open position which exposes the open face and a covering position which covers the open face during operation.

5. The portable snow skier rope towing system of claim 4 further comprising a kill switch operably connected with the motor and engaging the face cover, the kill switch being operable to disable the motor when the face cover is in any position other than the covering position.

6. The portable snow skier rope towing system of claim 3 further comprising an open face cover movably mounted relative to the housing for movement between an open position which exposes the open face and a covering position which covers the open face during operation, the face cover being pivotally mounted relative to the housing for swinging movement between the open and covering positions.

7. A portable snow skier rope towing system comprising:

an endless loop of flexible tow rope;

a series of pulleys supporting the endless loop of tow rope for driving about an elongated enclosed path, the elongated path having opposed extreme ends, each extreme end being defined by at least one pulley;

a supporting frame;

a motor operably mounted relative to the supporting frame, the motor having an output drive;

a winch apparatus operably connected with the motor output drive and relative to the supporting frame, the tow rope passing through the winch at a location within the enclosed path which is displaced from each of the extreme end pulleys, the winch apparatus comprising:

a drive wheel mounted for rotation and engagement with the output drive, the drive wheel having a circumference with a tapered groove formed thereabout which receives the tow rope;

a rope outlet pinch wheel mounted for rotation adjacent the drive wheel, the tow rope being received about the pinch wheel, the pinch wheel being mounted for selective movement relative to the drive wheel to urge the tow rope into the tapered circumferential drive wheel groove; the tow rope being received about at least 180° and less than 360° of the drive wheel circumference;

a housing having an open face; the drive wheel and pinch wheel being rotationally mounted relative to the open face;

means for mounting the pinch wheel for selective movement between a position closest to the drive wheel and a position furthest from the drive wheel;

the drive wheel and pinch wheel being positioned to define a winch path for the tow rope to be received through the winch about portions of each of the drive wheel and pinch wheel in operation; the rope winch path having an inlet end and an outlet end;

the drive wheel and pinch wheel being positioned relative to one another and on the housing open face to enable the selected diameter tow rope to be transversely removed from or transversely inserted into the rope winch path from the housing open face, when the pinch wheel is in the position furthest from the drive wheel, without requiring threading of the rope into the winch path from the inlet winch path end;

an open face cover movably mounted relative to the housing for movement between an open position which exposes the open face and a covering position which covers the open face during operation; and interconnecting linkage connecting the face cover with the pinch roller to impart movement of the pinch roller to the position closest to the drive wheel upon movement of the face cover to the covering position, and to impart movement of the pinch roller to the position furthest from the drive wheel upon movement of the face cover to the open position.

8. A portable snow skier rope towing system comprising:

an endless loop of flexible tow rope;

a series of pulleys supporting the endless loop of tow rope for driving about an elongated enclosed path, the elongated path having opposed extreme ends, each extreme end being defined by at least one pulley;

a supporting frame;

a motor operably mounted relative to the supporting frame, the motor having an output drive;

a winch apparatus operably connected with the motor output drive and relative to the supporting frame, the tow rope passing through the winch at a location within the enclosed path which is displaced from each of the extreme end pulleys, the winch apparatus comprising:

a drive wheel mounted for rotation and engagement with the output drive, the drive wheel having a circumference with a tapered groove formed thereabout which receives the tow rope;

a rope outlet pinch wheel mounted for rotation adjacent the drive wheel, the tow rope being received about the pinch wheel, the pinch wheel being mounted for selective movement relative to the drive wheel to urge the tow rope into the tapered circumferential drive wheel groove; the tow rope being received about at least 180° and less than 360° of the drive wheel circumference;

a housing having an open face; the drive wheel and pinch wheel being rotationally mounted relative to the open face;

means for mounting the pinch wheel for selective movement between a position closest to the drive wheel and a position furthest from the drive wheel;

the drive wheel and pinch wheel being positioned to define a winch path for the tow rope to be received through the winch about portions of each of the drive wheel and pinch wheel in operation; the rope winch path having an inlet end and an outlet end;

the drive wheel and pinch wheel being positioned relative to one another and on the housing open face to enable the selected diameter tow rope to be transversely removed from or transversely inserted into the rope winch path from the housing open face, when the pinch wheel is in the position furthest from the drive wheel, without requiring threading of the rope into the winch path from the inlet winch path end;

an open face cover movably mounted relative to the housing for movement between an open position which exposes the open face and a covering position which covers the open face during operation, the face cover being pivotally mounted relative to the housing for swinging movement between the open and covering positions; and interconnecting linkage connecting the pivoting face cover with the pinch roller to impart movement of the pinch roller to the position closest to the drive wheel upon pivoting movement of the face cover to the covering position, and to impart movement of the pinch roller to the position furthest from the drive wheel upon pivoting movement of the face cover to the open position.

9. The portable snow skier rope towing system of claim 8 further comprising a kill switch operably connected with the motor and engaging the face cover, the kill switch being operable to disable the motor when the face cover is in any position other than the covering position.

10. A portable snow skier rope towing system comprising:

an endless loop of flexible tow rope;

a series of pulleys supporting the endless loop of tow rope for driving about an elongated enclosed path, the elongated path having opposed extreme ends, each extreme end being defined by at least one pulley;

a supporting frame;

a motor operably mounted relative to the supporting frame, the motor having an output drive;

a winch apparatus operably connected with the motor output drive and relative to the supporting frame, the tow rope passing through the winch at a location within the enclosed path which is displaced from each of the extreme end pulleys, the winch apparatus comprising:

a drive wheel mounted for rotation and engagement with the output drive, the drive wheel having a circumference with a tapered groove formed thereabout which receives the tow rope;

a rope outlet pinch wheel mounted for rotation adjacent the drive wheel, the tow rope being received about the pinch wheel, the pinch wheel being mounted for selective movement relative to the drive wheel to urge the tow rope into the tapered circumferential drive wheel groove; the tow rope being received about at least 180° and less than 360° of the drive wheel circumference;

wherein the drive wheel comprises a metal body with the circumferential groove being formed thereabout, the circumferential groove comprising projections and valleys, the valleys being filled with a ceramic material to define an exterior driving rope tow bearing surface on the body within the groove having discrete metal portions and discrete ceramic portions.

11. A portable snow skier rope towing system comprising:

an endless loop of flexible tow rope;

a series of pulleys supporting the endless loop of tow rope for driving about an elongated enclosed path, the elongated path having opposed extreme ends, each extreme end being defined by at least one pulley;

a supporting frame;

a motor operably mounted relative to the supporting frame, the motor having an output drive;

a winch apparatus operably connected with the motor output drive and relative to the supporting frame, the tow rope passing through the winch at a location within the enclosed path which is displaced from each of the extreme end pulleys, the winch apparatus comprising:

a drive wheel mounted for rotation and engagement with the output drive, the drive wheel having a circumference with a tapered groove formed thereabout which receives the tow rope;

a rope outlet pinch wheel mounted for rotation adjacent the drive wheel, the tow rope being received about the pinch wheel, the pinch wheel being mounted for selective movement relative to the drive wheel to urge the tow rope into the tapered circumferential drive wheel groove; the tow rope being received about at least 180° and less than 360° of the drive wheel circumference;

wherein the drive wheel comprises a metal body with the circumferential groove being formed thereabout, the circumferential groove comprising projections and valleys, the valleys having knurled surfaces.

12. A portable snow skier rope towing system comprising:

an endless loop of flexible tow rope;

a series of pulleys supporting the endless loop of tow rope for driving about an elongated enclosed path, the elongated path having opposed extreme ends, each extreme end being defined by at least one pulley;

a supporting frame;

a motor operably mounted relative to the supporting frame, the motor having an output drive;

a winch apparatus operably connected with the motor output drive and relative to the supporting frame, the tow rope passing through the winch at a location within the enclosed path which is displaced from each of the extreme end pulleys, the winch apparatus comprising:

a drive wheel mounted for rotation and engagement with the output drive, the drive wheel having a circumference with a tapered groove formed thereabout which receives the tow rope;

a rope outlet pinch wheel mounted for rotation adjacent the drive wheel, the tow rope being received about the pinch wheel, the pinch wheel being mounted for selective movement relative to the drive wheel to urge the tow rope into the tapered circumferential drive wheel groove; the tow rope being received about at least 180° and less than 360° of the drive wheel circumference;

wherein tension in the rope is substantially uniform throughout the rope path when no skier is being pulled by the tow rope, tension in the rope is nonuniform throughout the path when a skier is being pulled by the tow rope;

an anchor, the anchor being movable relative to the motor to anchor the motor relative to some fixed external object, the motor being movable relative to the ground within limits upon anchoring relative to the fixed external object;

the motor having a power actuator, the power actuator being moveable from an idle position wherein the motor idles to an increased power position wherein the power output of the motor is increased, the power actuator being moveable relative to the motor, the power actuator being biased in the direction of the idle position; and switching means mounted relative to the motor and connected with the actuator and anchor for imparting simultaneous movement of, a) the motor relative to the anchor and ground, and b) movement of the actuator between the idle and increased power positions upon a change in tension throughout the enclosed tow rope path between being substantially uniform to being nonuniform; the switching means being automatically operable to, a) move the power actuator to the increased power position upon shifting from substantially uniform tension in the tow rope path to nonuniform tension throughout the tow rope path, and b) move the power actuator to the idle position upon shifting from nonuniform tension in the tow rope path to substantially uniform tension throughout the tow rope path.

13. A portable snow skier rope towing system comprising:

an endless loop of flexible tow rope;

a series of pulleys supporting the endless loop of tow rope for driving about an elongated enclosed path;

a drive unit comprising a motor and a drive wheel connected to the motor, the drive wheel engaging the endless loop of rope for driving the endless loop of rope about the enclosed path;

an anchor, the anchor being movable relative to the drive unit to anchor the drive unit relative to some fixed external object, the drive unit being movable relative to the ground within limits upon anchoring relative to the fixed external object;

the motor having a power actuator, the power actuator being moveable from an idle position wherein the motor idles to an increased power position wherein the power output of the motor is increased, the power actuator being moveable relative to the motor, the power actuator being biased in the direction of the idle position; and switching means operably connected between the anchor and the drive unit for moving the power actuator to the increased power position in response to a pulling force between the anchor and the drive unit, such pulling force being produced by displacement of the drive unit relative to the anchor when a skier grasps the tow rope.

14. The portable snow skier rope towing system of claim 13 wherein the switching means comprises a pivotally mounted lever, one end of the lever being connected with the anchor, the other end of the lever being connected with the actuator.

15. The portable snow skier rope towing system of claim 14 wherein the anchor comprises a flexible strap.

16. The portable snow skier rope towing system of claim 13 wherein the switching means comprises a pair of opposed members mounted for movement toward and away from one another, the opposed members being biased toward one another, one of the opposed members comprising the anchor, the other of the opposed members being stationarily mounted relative to the drive unit.

17. The portable snow skier rope towing system of claim 13 further comprising a supporting frame to which the drive unit is mounted, the anchor being movably connected to the supporting frame, the frame being movable relative to the ground within limits upon anchoring of the frame to the fixed external object, and the switching means being mounted on the frame.

18. A portable snow skier rope towing system comprising:

an endless loop of flexible tow rope;

a series of pulleys supporting the endless loop of tow rope for driving about an elongated enclosed path, the elongated path having opposed extreme ends, each extreme end being defined by at least one pulley, tension in the rope being substantially uniform throughout the path when no skier is being pulled by the tow rope, tension in the rope being nonuniform throughout the path when a skier is being pulled by the tow rope;

a supporting frame;

an anchor movably connected relative to the frame to anchor the frame relative to some fixed external object, the frame being movable relative to the ground within limits upon anchoring of the frame to the fixed external object;

a drive unit operably mounted relative to the supporting frame, the drive unit comprising a motor having an output drive shaft and a winch apparatus operably connected with the output drive shaft, the winch apparatus engaging the endless loop of rope at a location within the enclosed path which is displaced from each of the extreme end pulleys for driving the endless loop of rope about the enclosed path, the winch apparatus comprising:

a housing having a open face;

a drive wheel mounted to the output drive and relative to the open face, the drive wheel comprising a metal body having a circular circumference, the circumference having a tapered groove formed thereabout which receives the tow rope, the tapered groove having projections and valleys, the valleys being filled with a ceramic material to define an exterior driving rope tow bearing surface on the body within the groove having discrete metal portions and discrete ceramic portions;

a rope inlet wheel mounted relative to the housing open face adjacent the drive wheel for rotation relative to the open face, the inlet wheel having a circumferential groove which receives the tow rope; and a rope outlet pinch wheel mounted relative to the housing open face adjacent the drive wheel for rotation relative to the housing open face, the tow rope being received about the pinch wheel, the pinch wheel being mounted for selective movement relative to the drive wheel to urge the tow rope into the tapered circumferential drive wheel groove; the pinch wheel being so mounted for selective movement between a position closest to the drive wheel and a position furthest from the drive wheel; the drive wheel, rope inlet wheel, and pinch wheel being positioned to define a winch path over which the tow rope is received through the winch about portions of each of the drive wheel, rope inlet wheel, and pinch wheel in operation; the rope winch path wrapping the tow rope about more than 180° and less than 360° of the drive wheel circumference in operation;

the drive wheel, rope inlet wheel, and pinch wheel being positioned relative to one another and on the housing open face to enable the selected diameter tow rope to be transversely removed from or transversely inserted into the rope winch path from the housing open face, when the pinch wheel is in the position furthest from the drive wheel, without requiring threading of the rope into the winch path from the inlet winch path end;

an open face cover movably mounted relative to the housing for movement between an open position which exposes the open face and a covering position which covers the open face during operation;

interconnecting linkage connecting the face cover with the pinch roller to impart movement of the pinch roller to the position closest to the drive wheel upon movement of the face cover to the covering position, and to impart movement of the pinch roller to the position furthest from the drive wheel upon movement of the face cover to the open position;

the motor having a power actuator, the power actuator being moveable from an idle position wherein the motor idles to an increased power position wherein the power output of the motor is increased, the power actuator being moveable relative to the supporting frame, the power actuator being biased by in the direction of the idle position; and switching means mounted relative to the drive unit and supporting frame and connected with the actuator and anchor for imparting simultaneous movement of, a) the supporting frame relative to the anchor and ground, and b) movement of the actuator between the idle and increased power positions upon a change in tension throughout the enclosed tow rope path between being substantially uniform to being nonuniform; the switching means being automatically operable to, a) move the power actuator to the increased power position upon shifting from substantially uniform tension in the tow rope path to nonuniform tension throughout the tow rope path, and b) move the power actuator to the idle position upon shifting from nonuniform tension in the tow rope path to substantially uniform tension throughout the tow rope path.

19. The portable snow skier rope towing system of claim 18 wherein the location within the enclosed path where the tow rope passes through the winch apparatus is positionally between the extreme path ends.

20. The portable snow skier rope towing system of claim 18 wherein the face cover is pivotally mounted relative to the housing for swinging movement between the open and covering positions.

21. The portable snow skier rope towing system of claim 18 wherein the switching means comprises a lever pivotally mounted on the supporting frame, one end of the lever being mounted to the anchor, the other end of the lever being connected to the actuator.

22. The portable snow skier rope towing system of claim 21 wherein the anchor comprises a flexible strap.

23. The portable snow skier rope towing system of claim 18 wherein, the location within the enclosed path where the tow rope passes through the winch apparatus is positionally between the extreme path ends;

the face cover is pivotally mounted relative to the housing for swinging movement between the open and covering positions;

the switching means comprises a lever pivotally mounted on the supporting frame, one end of the lever being mounted to the anchor, the other end of the lever being connected to the actuator; and the anchor comprises a flexible strap.

24. A snow skier rope tow winch apparatus capable of drawing a flexible tow rope of selected diameter therethrough, the rope two winch apparatus comprising:

a housing having an open face;

a drive wheel mounted to the housing for rotation relative to the housing open face, the drive wheel having a tapered circumferential groove for receiving a flexible tow rope of a selected diameter;

a rope outlet pinch wheel mounted relative to the housing open face adjacent to the drive wheel for rotation relative to the housing open face;

means for mounting the pinch wheel for selective movement relative to the drive wheel to urge the tow rope into the tapered circumferential drive wheel groove and thereby against the drive wheel for driving the two rope around the drive wheel, the pinch wheel being so mounted for selective movement between a position closest to the drive wheel and a position furthest from the drive wheel;

the drive wheel and pinch wheel being positioned to define a winch path for the tow rope to be received through the winch about portions of each of the drive wheel and pinch wheel in operation; the rope winch path having an inlet end and an outlet end;

the rope winch path wrapping the tow rope about less than 360° of the drive wheel circumference in operation;

the drive wheel and pinch wheel being positioned relative to one another and on the housing open face to enable the selected diameter tow rope to be transversely removed from or transversely inserted into the rope winch path from the housing open face, when the pinch wheel is in the position furthest from the drive wheel, without requiring threading of the rope into the winch path from the inlet winch path end; and interconnecting linkage connecting the face cover with the pinch roller to impart movement of the pinch roller to the position closest to the drive wheel upon movement of the face cover to the covering position, and to impart movement of the pinch roller to the position furthest from the drive wheel upon movement of the face cover to the open position.

25. A snow skier rope tow winch apparatus capable of drawing a flexible tow rope of selected diameter therethrough, the rope tow winch apparatus comprising:

a housing having an open face;

a drive wheel mounted to the housing for rotation relative to the housing open face, the drive wheel having a tapered circumferential groove for receiving a flexible tow rope of a selected diameter;

a rope outlet pinch wheel mounted relative to the housing open face adjacent to the drive wheel for rotation relative to the housing open face;

means for mounting the pinch wheel for selective movement relative to the drive wheel to urge the tow rope into the tapered circumferential drive wheel groove and thereby against the drive wheel for driving the tow rope around the drive wheel, the pinch wheel being so mounted for selective movement between a position closest to the drive wheel and a position furthest from the drive wheel;

the drive wheel and pinch wheel being positioned to define a winch path for the tow rope to be received through the winch about portions of each of the drive wheel and pinch wheel in operation; the rope winch path having an inlet end and an outlet end; the rope winch path wrapping the tow rope about less than 360° of the drive wheel circumference in operation;

the drive wheel and pinch wheel being positioned relative to one another and on the housing open face to enable the selected diameter tow rope to be transversely removed from or transversely inserted into the rope winch path from the housing open face, when the pinch wheel is in the position furthest from the drive wheel, without requiring threading of the rope into the winch path from the inlet winch path end;

an open face cover movably mounted relative to the housing for movement between an open position which exposes the open face and a covering position which covers the open face during operation, the face cover being pivotally mounted relative to the housing for swinging movement between the open and covering positions; and interconnecting linkage connecting the pivoting face cover with the pinch roller to impart movement of the pinch roller to the position closest to the drive wheel upon pivoting movement of the face cover to the covering position, and to impart movement of the pinch roller to the position furthest from the drive wheel upon pivoting movement of the face cover to the open position.

26. A snow skier rope tow winch apparatus capable of drawing a flexible tow rope of selected diameter therethrough, the rope tow winch apparatus comprising:

a housing having an open face;

a drive wheel mounted to the housing for rotation relative to the housing open face, the drive wheel having a tapered circumferential groove for receiving a flexible tow rope of a selected diameter;

a rope outlet pinch wheel mounted relative to the housing open face adjacent to the drive wheel for rotation relative to the housing open face;

means for mounting the pinch wheel for selective movement relative to the drive wheel to urge the tow rope into the tapered circumferential drive wheel groove and thereby against the drive wheel for driving the tow rope around the drive wheel, the pinch wheel being so mounted for selective movement between a position closest to the drive wheel and a position furthest from the drive wheel;

the drive wheel and pinch wheel being positioned to define a winch path for the tow rope to be received through the winch about portions of each of the drive wheel and pinch wheel in operation; the rope winch path having an inlet end and an outlet end; the rope winch path wrapping the tow rope about less than 360° of the drive wheel circumference in operation;

the drive wheel and pinch wheel being positioned relative to one another and on the housing open face to enable the selected diameter tow rope to be transversely removed from or transversely inserted into the rope winch path from the housing open face, when the pinch wheel is in the position furthest from the drive wheel, without requiring threading of the rope into the winch path from the inlet winch path end;

wherein the drive wheel comprises a metal body with the circumferential groove being formed thereabout, the circumferential groove comprising projections and valleys, the valleys being filled with a ceramic material to define an exterior driving rope tow bearing surface on the body within the groove having discrete metal portions and discrete ceramic portions.

27. A snow skier rope tow winch apparatus capable of drawing a flexible tow rope of selected diameter therethrough, the rope tow winch apparatus comprising:

a housing having an open face;

a drive wheel mounted to the housing for rotation relative to the housing open face, the drive wheel having a tapered circumferential groove for receiving a flexible tow rope of a selected diameter;

a rope outlet pinch wheel mounted relative to the housing open face adjacent to the drive wheel for rotation relative to the housing open face;

means for mounting the pinch wheel for selective movement relative to the drive wheel to urge the tow rope into the tapered circumferential drive wheel groove and thereby against the drive wheel for driving the tow rope around the drive wheel, the pinch wheel being so mounted for selective movement between a position closest to the drive wheel and a position furthest from the drive wheel;

the drive wheel and pinch wheel being positioned to define a winch path for the two rope to be received through the winch about portions of each of the drive wheel and pinch wheel in operation; the rope winch path having an inlet end and an outlet end; the rope winch path wrapping the tow rope about less than 360° of the drive wheel circumference in operation;

the drive wheel and pinch wheel being positioned relative to one another and on the housing open face to enable the selected diameter tow rope to be transversely removed from or transversely inserted into the rope winch path from the housing open face, when the pinch wheel is in the position furthest from the drive wheel, without requiring threading of the rope into the winch path from the inlet winch path end;

wherein the drive wheel comprises a metal body with the circumferential groove being formed thereabout, the circumferential groove comprising projections and valleys, the valleys having knurled surfaces.

28. A snow skier rope tow winch drive wheel for a portable, snow skier towing apparatus which receives a flexible tow rope therethrough for pulling a skier over snow, the drive wheel comprising:

a metal body having a circular circumference, the circumference having a tapered groove formed thereabout for receiving a flexible tow rope of a selected diameter, the tapered groove having projections and valleys, the valleys being filled with a ceramic material to define an exterior driving rope tow bearing surface on the body within the groove having discrete metal portions and discrete ceramic portions.

29. A portable snow skier rope towing system comprising:

an endless loop of flexible tow rope;

a series of pulleys supporting the endless loop of tow rope for driving about an elongated enclosed path, tension in the rope being substantially uniform throughout the path when no skier is being pulled by the tow rope, tension in the rope being nonuniform throughout the path when a skier is being pulled by the tow rope;

a drive unit comprising a motor and a drive wheel connected to the motor, the drive wheel engaging the endless loop of rope for driving the endless loop of rope about the enclosed path;

an anchor, the anchor being movable relative to the drive unit to anchor the drive unit relative to some fixed external object, the drive unit being movable relative to the ground within limits upon anchoring relative to the fixed external object;

the motor having a power actuator, the power actuator being moveable from an idle position wherein the motor idles to an increased power position wherein the power output of the motor is increased, the power actuator being moveable relative to the motor, the power actuator being biased in the direction of the idle position;

switching means mounted relative to the drive unit and connected with the actuator and anchor for imparting simultaneous movement of, a) the drive unit relative to the anchor and ground, and b) movement of the actuator between the idle and increased power positions upon a change in tension throughout the enclosed tow rope path between being substantially uniform to being nonuniform; the switching means being automatically operable to, a) move the power actuator to the increased power position upon shifting from substantially uniform tension in the tow rope path to nonuniform tension throughout the tow rope path, and b) move the power actuator to the idle position upon shifting from nonuniform tension in the tow rope path to substantially uniform tension throughout the tow rope path;

wherein the switching means comprises a pivotally mounted lever, one end of the lever being connected with the anchor, the other end of the lever being connected with the actuator.

30. A portable snow skier rope towing system comprising:

an endless loop of flexible tow rope;

a series of pulleys supporting the endless loop of tow rope for driving about an elongated enclosed path, tension in the rope being substantially uniform throughout the path when no skier is being pulled by the tow rope, tension in the rope being nonuniform throughout the path when a skier is being pulled by the tow rope;

a drive unit comprising a motor and a drive wheel connected to the motor, the drive wheel engaging the endless loop of rope for driving the endless loop of rope about the enclosed path;

an anchor, the anchor being movable relative to the drive unit to anchor the drive unit relative to some fixed external object, the drive unit being movable relative to the ground within limits upon anchoring relative to the fixed external object;

the motor having a power actuator, the power actuator being moveable from an idle position wherein the motor idles to an increased power position wherein the power output of the motor is increased, the power actuator being moveable relative to the motor, the power actuator being biased in the direction of the idle position;

switching means mounted relative to the drive unit and connected with the actuator and anchor for imparting simultaneous movement of, a) the drive unit relative to the anchor and ground, and b) movement of the actuator between the idle and increased power positions upon a change in tension throughout the enclosed tow rope path between being substantially uniform to being nonuniform; the switching means being automatically operable to, a) move the power actuator to the increased power position upon shifting from substantially uniform tension in the tow rope path to nonuniform tension throughout the tow rope path, and b) move the power actuator to the idle position upon shifting from nonuniform tension in the tow rope path to substantially uniform tension throughout the tow rope path;

wherein the anchor comprises a flexible strap.

31. A portable snow skier rope towing system comprising:

an endless loop of flexible tow rope;

a series of pulleys supporting the endless loop of tow rope for driving about an elongated enclosed path, tension in the rope being substantially uniform throughout the path when no skier is being pulled by the tow rope, tension in the rope being nonuniform throughout the path when a skier is being pulled by the tow rope;

a drive unit comprising a motor and a drive wheel connected to the motor, the drive wheel engaging the endless loop of rope for driving the endless loop of rope about the enclosed path;

an anchor, the anchor being movable relative to the drive unit to anchor the drive unit relative to some fixed external object, the drive unit being movable relative to the ground within limits upon anchoring relative to the fixed external object;

the motor having a power actuator, the power actuator being moveable from an idle position wherein the motor idles to an increased power position wherein the power output of the motor is increased, the power actuator being moveable relative to the motor, the power actuator being biased in the direction of the idle position;

switching means mounted relative to the drive unit and connected with the actuator and anchor for imparting simultaneous movement of, a) the drive unit relative to the anchor and ground, and b) movement of the actuator between the idle and increased power positions upon a change in tension throughout the enclosed tow rope path between being substantially uniform to being nonuniform; the switching means being automatically operable to, a) move the power actuator to the increased power position upon shifting from substantially uniform tension in the tow rope path to nonuniform tension throughout the tow rope path, and b) move the power actuator to the idle position upon shifting from nonuniform tension in the tow rope path to substantially uniform tension throughout the tow rope path;

wherein the switching means comprises a pair of opposed members mounted for movement toward and away from one another, the opposed members being biased toward one another, one of the opposed members comprising the anchor, the other of the opposed members being stationarily mounted relative to the drive unit.

32. A portable snow skier rope towing system comprising:

an endless loop of flexible tow rope;

a series of pulleys supporting the endless loop of tow rope for driving about an elongated enclosed path, the elongated path having opposed extreme ends, each extreme end being defined by at least one pulley;

a supporting frame;

a motor operably mounted relative to the supporting frame, the motor having an output drive;

switching means operably connected to the supporting frame for increasing the power output of the motor in response to the supporting frame being displaced toward a skier when the skier grasps the tow rope; and a winch apparatus operably connected with the motor output drive and relative to the supporting frame, the tow rope passing through the winch at a location within the enclosed path which is displaced from each of the extreme end pulleys, the winch apparatus comprising:

a drive wheel mounted for rotation and engagement with the output drive, the drive wheel having a circumference with a tapered groove formed thereabout which receives the tow rope; and a rope outlet pinch wheel mounted for rotation adjacent the drive wheel, the tow rope being received about the pinch wheel, the pinch wheel being mounted for selective movement relative to the drive wheel to urge the tow rope into the tapered circumferential drive wheel groove; the tow rope being received about at least 180° and less than 360° of the drive wheel circumference.

* * * * *